US006832864B2

(12) United States Patent
Patton et al.

(10) Patent No.: US 6,832,864 B2
(45) Date of Patent: Dec. 21, 2004

(54) PRINTING APPARATUS FOR PRINTING AN IMAGE ON A SELECTED SURFACE

(75) Inventors: David L. Patton, Webster, NY (US); Loretta E. Allen, Hilton, NY (US); Dale F. McIntyre, Honeoye Falls, NY (US)

(73) Assignee: Eastman Kodak Company, Rochester, NY (US)

( * ) Notice: Subject to any disclaimer, the term of this patent is extended or adjusted under 35 U.S.C. 154(b) by 12 days.

(21) Appl. No.: 10/346,148

(22) Filed: Jan. 16, 2003

(65) Prior Publication Data

US 2004/0141784 A1 Jul. 22, 2004

(51) Int. Cl.[7] ..... B41J 19/30; B41J 19/00; B43L 13/00

(52) U.S. Cl. ..... 400/323; 400/323.1; 400/319; 400/320; 400/283; 33/18.1; 33/21.1; 33/26

(58) Field of Search ..... 400/323, 323.1, 400/319, 320, 283; 33/18.1, 21.1, 26

(56) References Cited

U.S. PATENT DOCUMENTS 3,867,882 A * 2/1975 Ahlgren et al. ..... 101/35
4,920,422 A * 4/1990 Lapierre ..... 358/296
4,937,678 A * 6/1990 Murai et al. ..... 358/528
5,806,996 A * 9/1998 Leys et al. ..... 400/120.16
5,972,111 A * 10/1999 Anderson ..... 118/300
6,058,843 A * 5/2000 Young ..... 101/483
6,059,392 A * 5/2000 Park ..... 347/8
6,295,737 B2 10/2001 Patton et al.
6,341,831 B1 * 1/2002 Weber et al. ..... 347/1
6,360,656 B2 * 3/2002 Kubo et al. ..... 101/35
6,467,978 B1 * 10/2002 Tideman, Jr. ..... 400/76
6,536,345 B1 * 3/2003 Young ..... 101/485

FOREIGN PATENT DOCUMENTS

FR 2601265 A * 1/1988 ..... B05B/7/24
JP 2001171152 A * 6/2001 ..... B41J/2/21
JP 2002149238 A * 5/2002 ..... G05D/1/02

* cited by examiner

*Primary Examiner*—Daniel J. Colilia
*Assistant Examiner*—Marvin P. Crenshaw
(74) *Attorney, Agent, or Firm*—Roger A. Fields; Mark G. Bocchetti

(57) ABSTRACT

Printing apparatus for printing an image on a selected surface, includes a print head for printing the image, respective supports for the print head that allow the print head to translate left and right along an x-axis and to translate up and down along a y-axis perpendicular to the x-axis to move the print head over the selected surface, and respective supports for the print head that allow the print head to translate forward and rearward along a z-axis perpendicular to the x-and y-axes and to swing in a plurality of curves from the z-axis in order to adjust the print head for surface variations on the selected surface.

12 Claims, 22 Drawing Sheets

PRINTING APPARATUS FOR PRINTING AN IMAGE ON A SELECTED SURFACE

CROSS REFERENCE TO RELATED APPLICATIONS

Reference is made to commonly assigned, co-pending application Ser. No. 10/366,933 entitled Large Area Marking Device and Method for Printing and filed Feb. 14, 2003 in the names of David L. Patton et al.

FIELD OF THE INVENTION

This invention relates to a printing apparatus for printing an image on a selected surface.

BACKGROUND OF THE INVENTION

It is often desirable to form color images on a large vertical surface such as a wall. For example, people enjoy decorating the walls of their homes by applying stenciling or creating murals either by painting the murals or applying wallpaper murals. Even though most people would like to create their own stencil or mural, they do not usually have the ability to draw detailed objects, characters, scenes, and the like. People enjoy stenciling and murals but have to choose from stencils and murals that have been created by someone else. It would be much more enjoyable and satisfying if one could design their own stencil or create their own mural. Therefore, it is desirable to provide a marking or printing apparatus capable of forming images on a large vertical surface such as a wall.

In other instances businesses such a grocery or general merchandise retailers have the need to print images on a large vertical surface. These retailers often paint advertisements on their windows. The advertisements usually change on a weekly basis, and are hand painted by someone who possesses the artistic ability. The process because it is done by hand is very time consuming and expensive due to the high labor content involved in the operation.

A device named the "Magic Vertical Printer" is disclosed at a web-site http://www.simmagic.com/magic. The "Magic Vertical Printer" runs on a vertical frame and prints via an inkjet print head onto flat objects mounted on a vertical "Base Plate". The printer head moves left-right and up-down. It is not intended to print directly onto a wall or window, and will not print around a corner.

Prior art U.S. Pat. No. 6,295,737, issued Oct. 2, 2001, discloses printing apparatus for printing an image on a selected surface. The printing apparatus comprises a print head for printing the image, one support for the print head that allows the print head to translate horizontally left and right, another support for the print head that allows the print head to translate vertically up and down, and another support for the print head that allows the print head to swing in a plurality of curves. The printing apparatus is limited to printing on a small object such as a bust or figurine.

SUMMARY OF THE INVENTION

Printing apparatus for printing an image on a selected surface comprising:

a print head for printing the image;

respective supports for said print head that allow said print head to translate left and right along an x-axis and to translate up and down along a y-axis perpendicular to the x-axis to move said print head over the selected surface; and respective supports for said print head that allow said print head to translate forward and rearward along a z-axis perpendicular to the x- and y-axes and to swing in a plurality of curves from the z-axis in order to adjust said print head for surface variations on the selected surface.

DETAILED DESCRIPTION OF THE INVENTION

Figure 1:
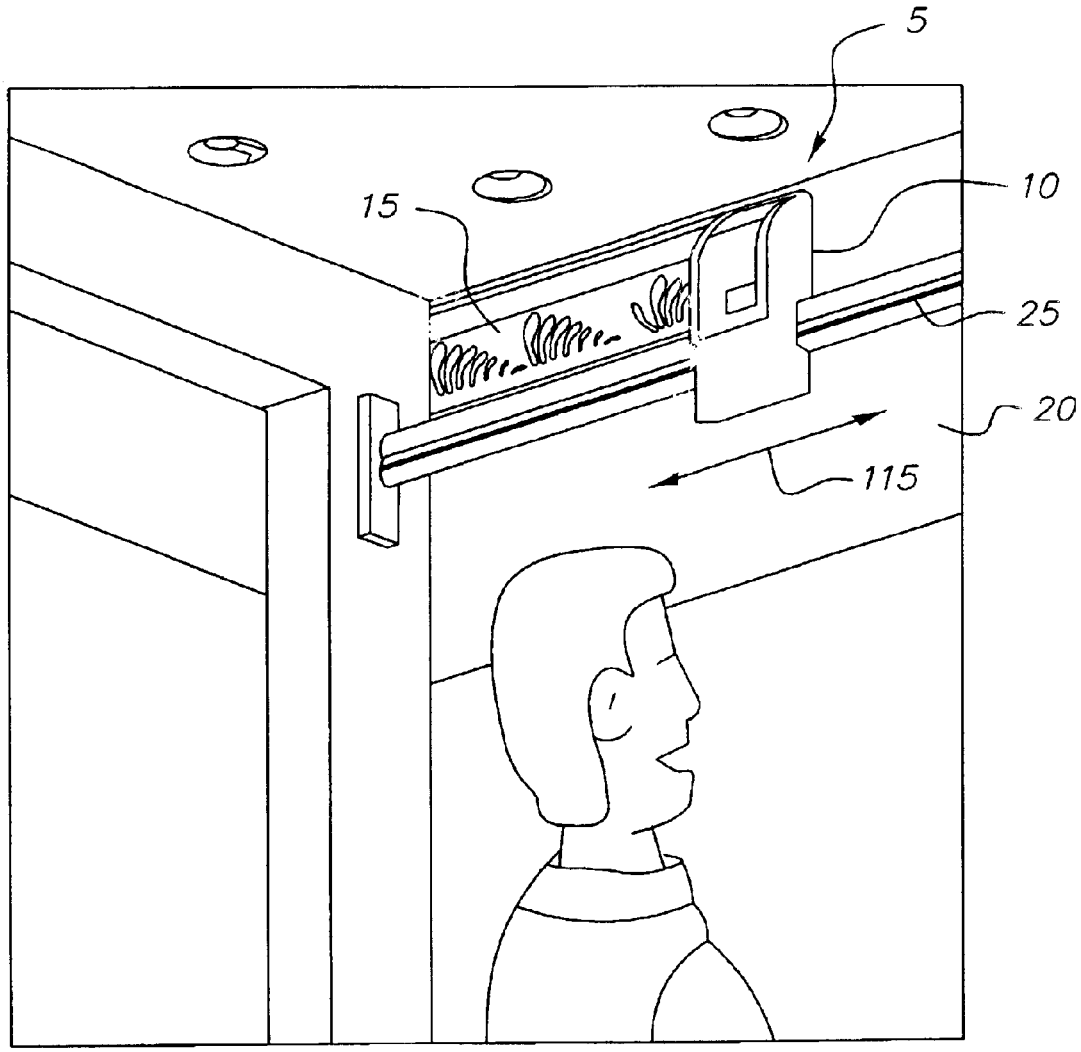
FIG. 1 is a perspective view of a printing apparatus according to a preferred embodiment of the invention.

FIG. 1 shows a printing apparatus 5 having a marking engine 10 for printing indicia (preferably an image) 15 on a large-size selected surface 20 such as a wall. An x-axis horizontal member or support 25 described later in connection with FIGS. 2*a*, 3*a*, 9*a* and 9*b* supports the marking engine 10 for translation left and right in FIG. 7*a*, parallel to the selected surface 20, as it prints the indicia 15 on the selected surface. In FIG. 7*a*, the indicia 15 is a color decorative upper border on the wall 20. The left and right translation of the marking engine 10, parallel to the selected surface 20, is along an x-axis as indicated by the double-headed arrow 115 in FIGS. 1 and 7*a*.

Figure 2A:
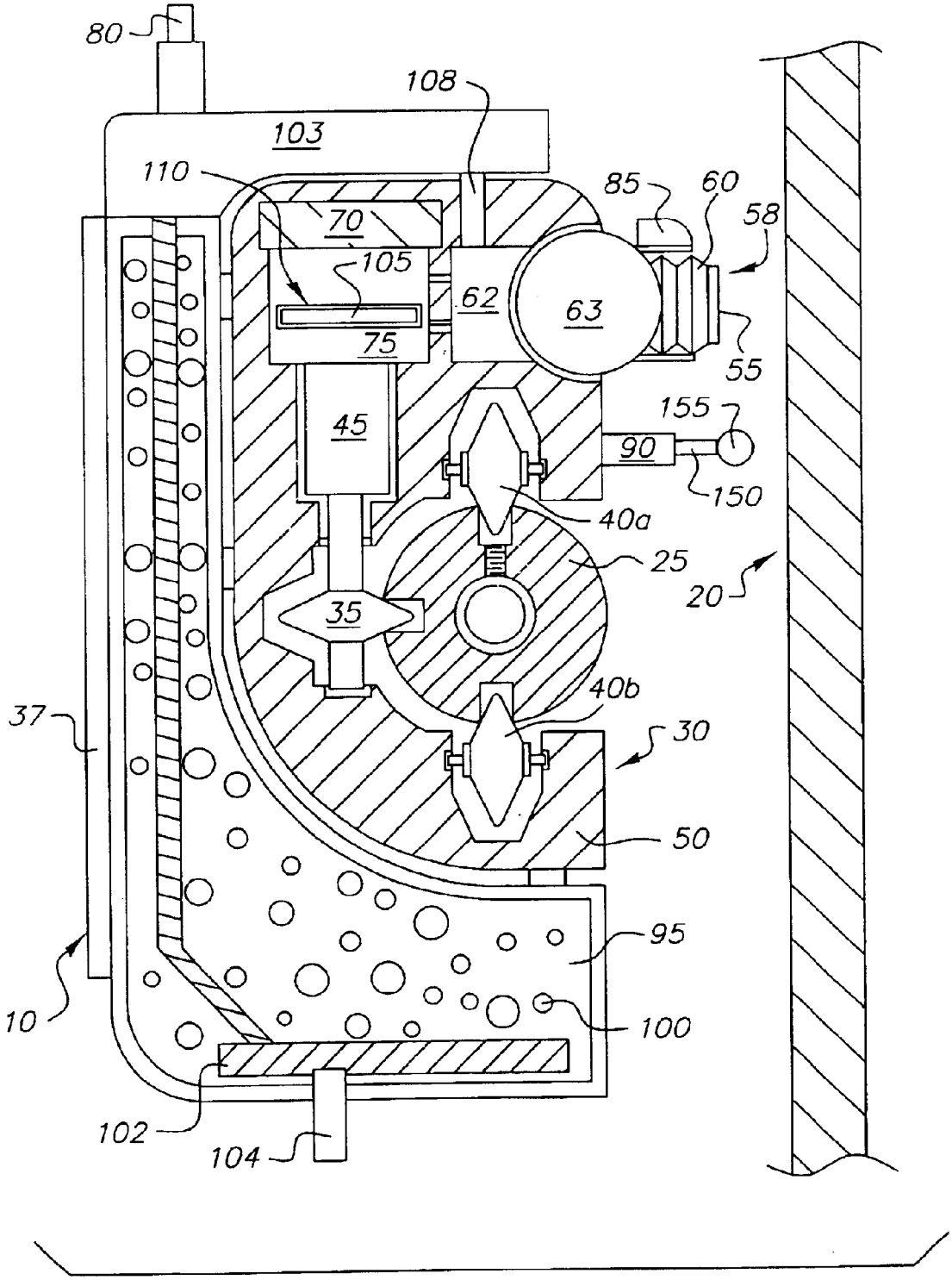
FIG. 2*a* is an elevation view of the printing apparatus.

As shown in FIG. 2*a*, the marking engine 10 includes a propulsion assembly 30 consisting of a drive wheel 35 driven by a stepper motor 45 and a pair of guide wheels 40*a* and 40*b*, each with an encoder not shown. The stepper motor 45 and the pair of guide wheels 40*a* and 40*b* are mounted on a frame 50. A thermo-mechanically activated DOD (Drop on Demand) print head 55, which may be a piezoelectric inkjet print head of the type disclosed in prior art assigned U.S. Pat. No. 6,295,737, issued Oct. 2, 2001, is mounted on a positioning mechanism 58 having a z-axis telescoping mechanism or support 60, which in turn is mounted on a rotating mechanism 62. The rotating mechanism 62 is a ball-in-socket joint 63 that connects the print head 55 and the telescoping mechanism 60. The telescoping mechanism 60 allows the prints head to translate forward and rearward towards and away from the selected surface 20 along a z-axis perpendicular to the x-axis 115 as indicated by the double-headed arrow 65*a* in FIG. 2*b*. The ball-in socket joint 63 allows the print head 55 to swing in a plurality of curves from the z-axis 65*a* as indicated by the doubled-headed arrows 65*b* and 65*c*. The double-headed arrow 65*b* depicts a vertical curve in FIG. 2*b*, and the double-headed arrow 65*c* depicts a horizontal curve in FIG. 2*b*.

U.S. Pat. No. 6,295,737 is incorporated into this application.

In FIG. 2*a* the marking engine 10 is shown to have a power supply 70, a logic, control and memory unit 75, a communications device 80, a sensor 85, a guide finger 90, and an ink reservoir 95. Although only one reservoir is shown, there may be more than one. The reservoir 95 contains a marking solution 100, for example cyan, magenta, yellow, white and/or black ink. However, the marking solution can be other forms such as dye, paint, or pigment, and it can be permanent or washable. The marking solution is fed in FIG. 2*a* into the reservoir 100 from an outside source via an outside inlet port 104, is fed from the reservoir by a pickup 102 via pump 103, and is supplied to the print head 55 via a tube 108. The pump 103 may alternatively feed the marking solution 100 from an outside supply not shown via the inlet port 104. The marking engine 10 is controlled by the logic, control and memory unit 75, which may receive instructions either from an input panel 37, an own internal memory source, the communication device 80, from the sensor 85, the guide finger 90 or an Erasable Programmable Read Only Memory (EPROM) 105 which can be inserted into an Erasable Programmable Read Only Memory (EPROM) slot 110. The logic, control and memory unit 75 uses instructions from the aforementioned sources to control the marking engine 10, the print head 55, and the propulsion assembly 30 to form the indicia 15 on the selected surface 20. The logic, control and memory unit 75 is connected to the print head 55, the z-axis telescoping mechanism 60, the rotating mechanism 62, and the sensors 85 and/or the guide finger 90 for controlling x, y, and z coordinate positions of the marking engine 10 in relationship to the surface 20. Details regarding up and down translation of the marking engine 10, parallel to the selected surface 20, along a y-axis perpendicular to the x- and z-axes 115 and 65*a* as indicated by the double-headed arrow 465 in FIG. 7*b* are later described.

Figure 2B:
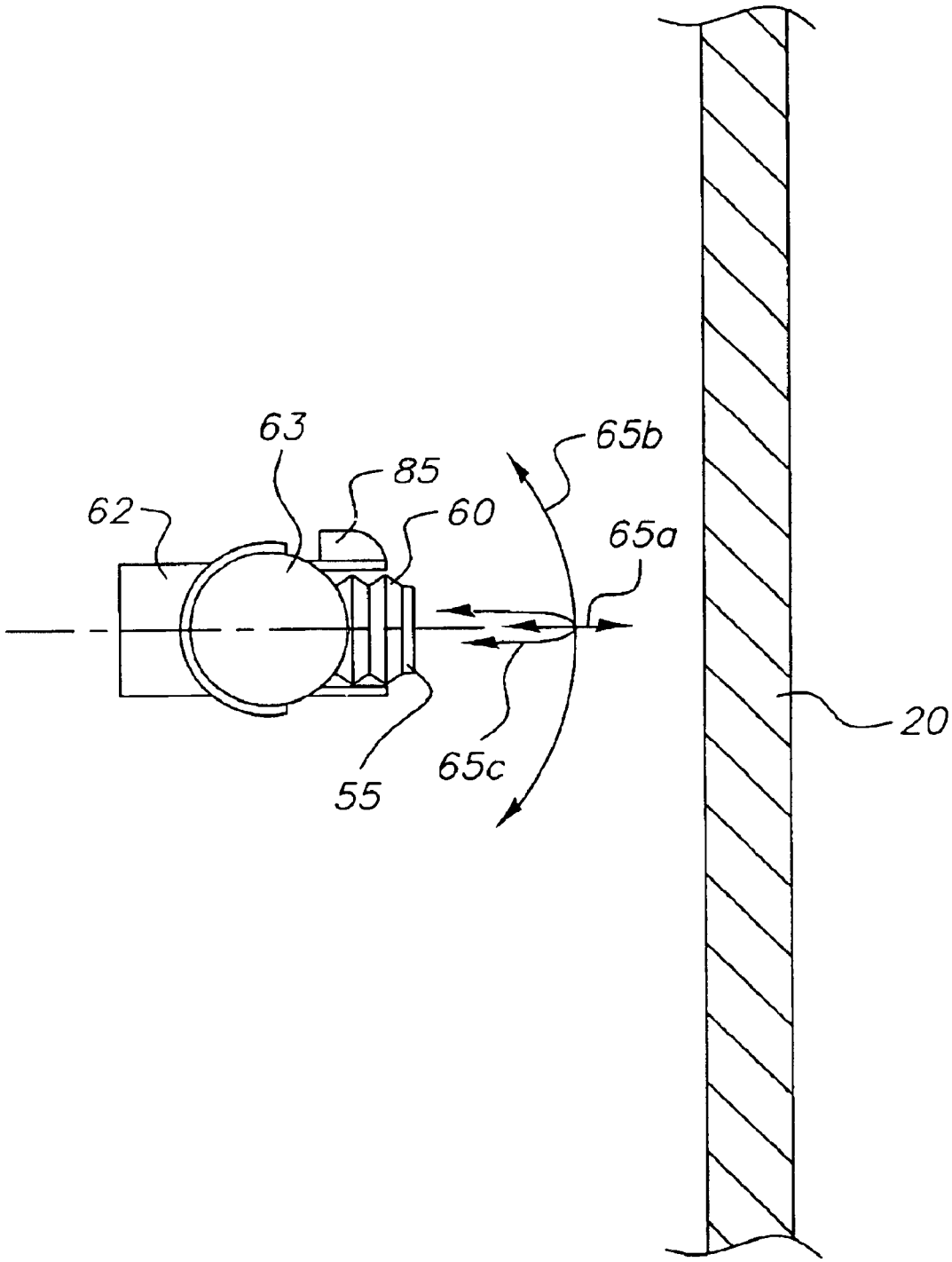
FIG. 2*b* is an elevation view of a printing head, a sensor and telescoping and rotating supports for the print head, in the printing apparatus.

The x-axis horizontal member 25 allows the marking engine 10 to be positioned adjacent to the selected surface 20 and to translate left and right along the x-axis 115, and is adjustable to give the x-axis a horizontal orientation as indicated in FIGS. 7*a*–7*d* and 9*a*–9*d*. The print head 55 as shown in FIG. 2*b* maybe rotated as indicated by the arrows 65*a* and 65*b* to permit the print to print around a corner. See FIG. 10*d*.

Figure 7D:
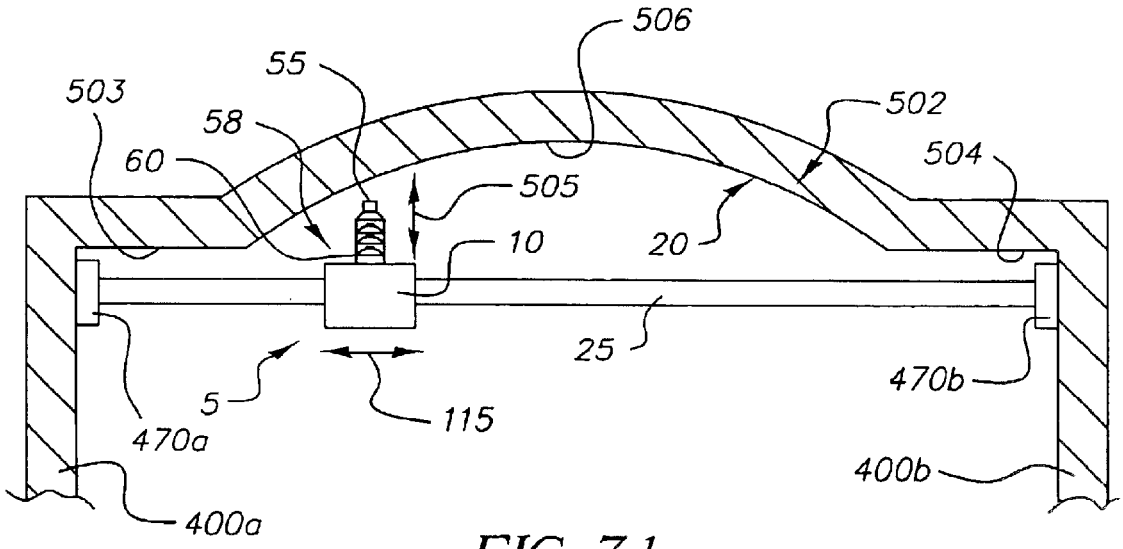
FIG. 7*d* is a plan view depicting how the printing apparatus prints an image on flat and contoured areas of a selected surface.
Figure 7A:
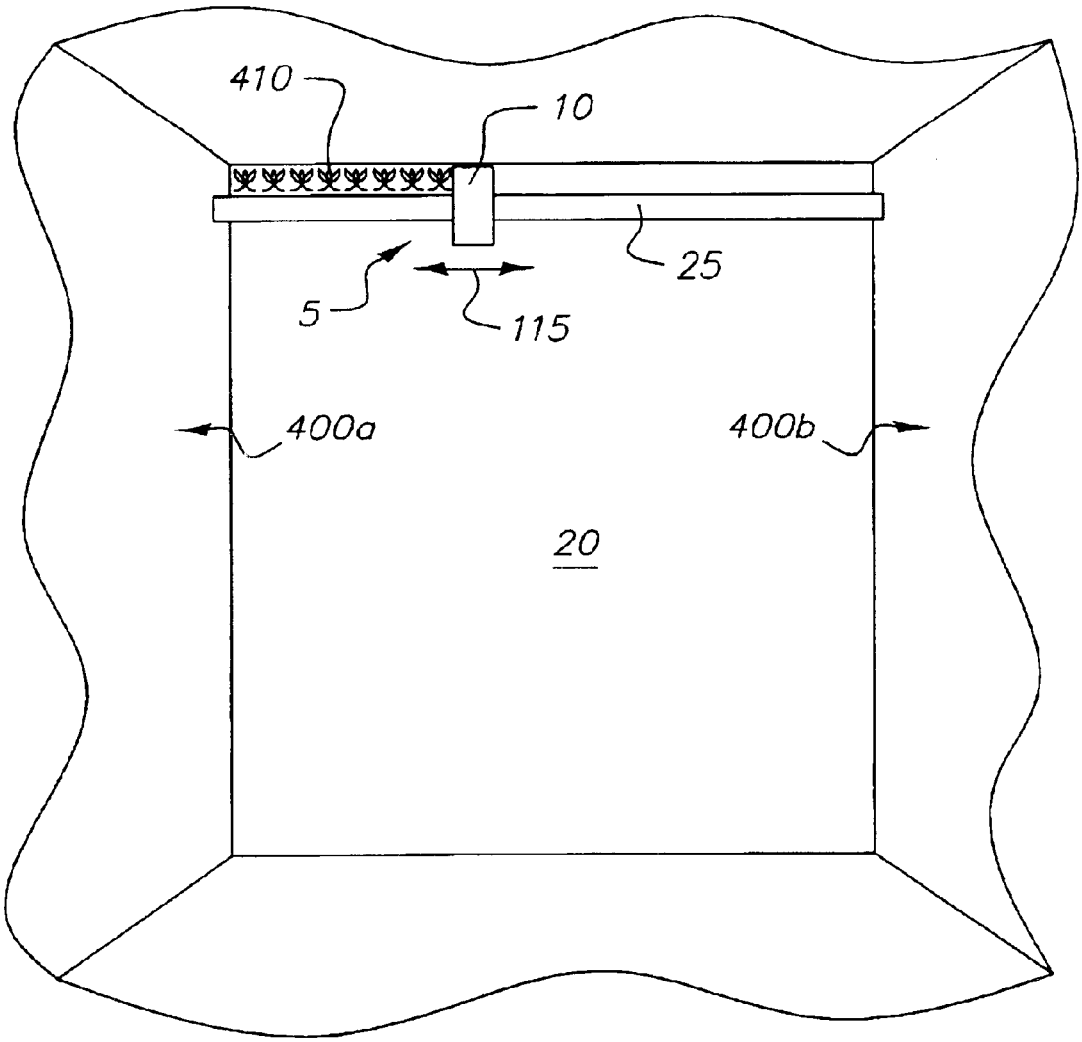
FIG. 7*a* is a perspective view depicting how the printing apparatus prints an image on a selected surface such as a wall.
Figure 7B:
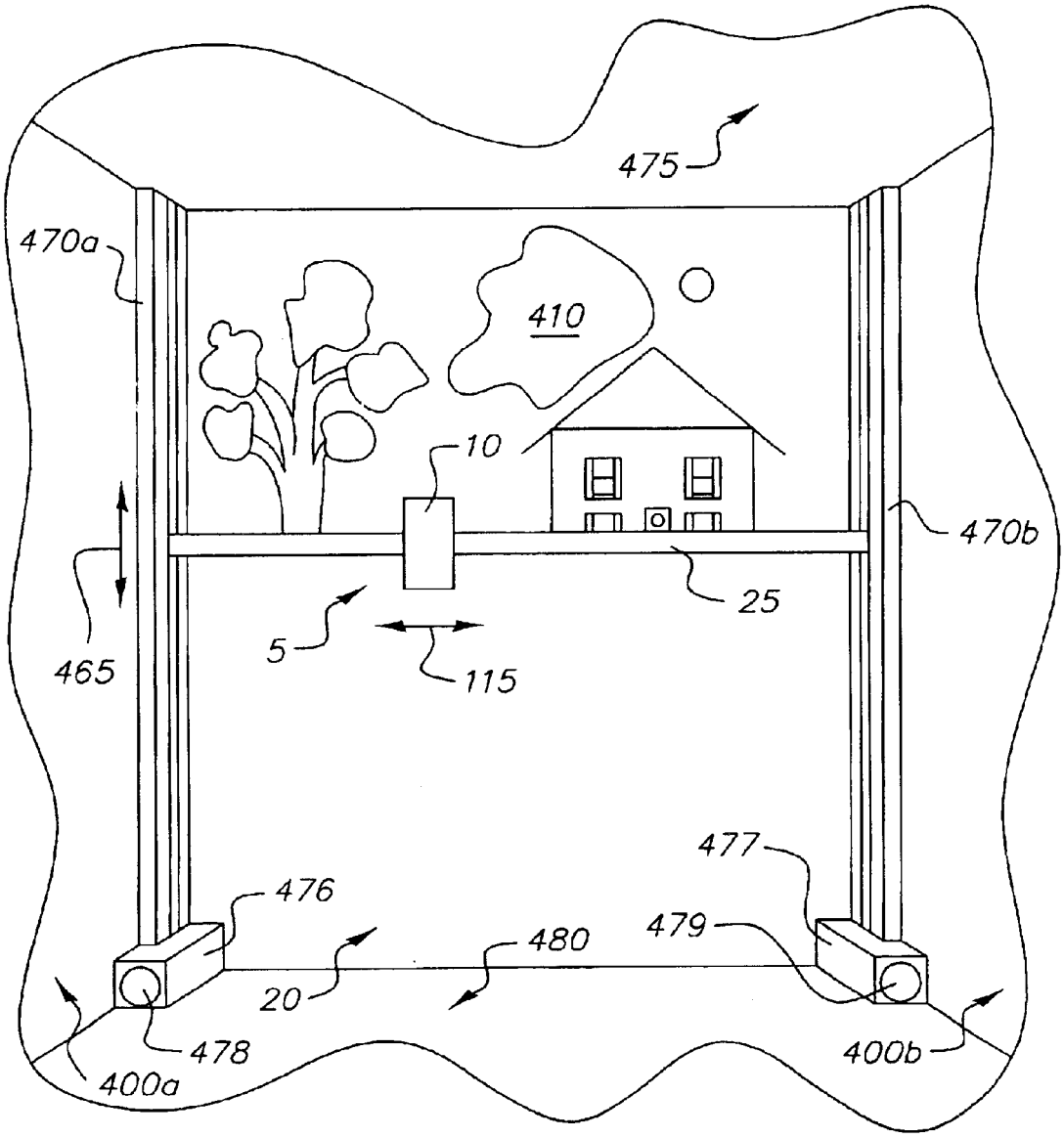
FIG. 7*b* is a perspective view representing a variation of the printing apparatus in FIG. 7*a;*
Figure 10A:
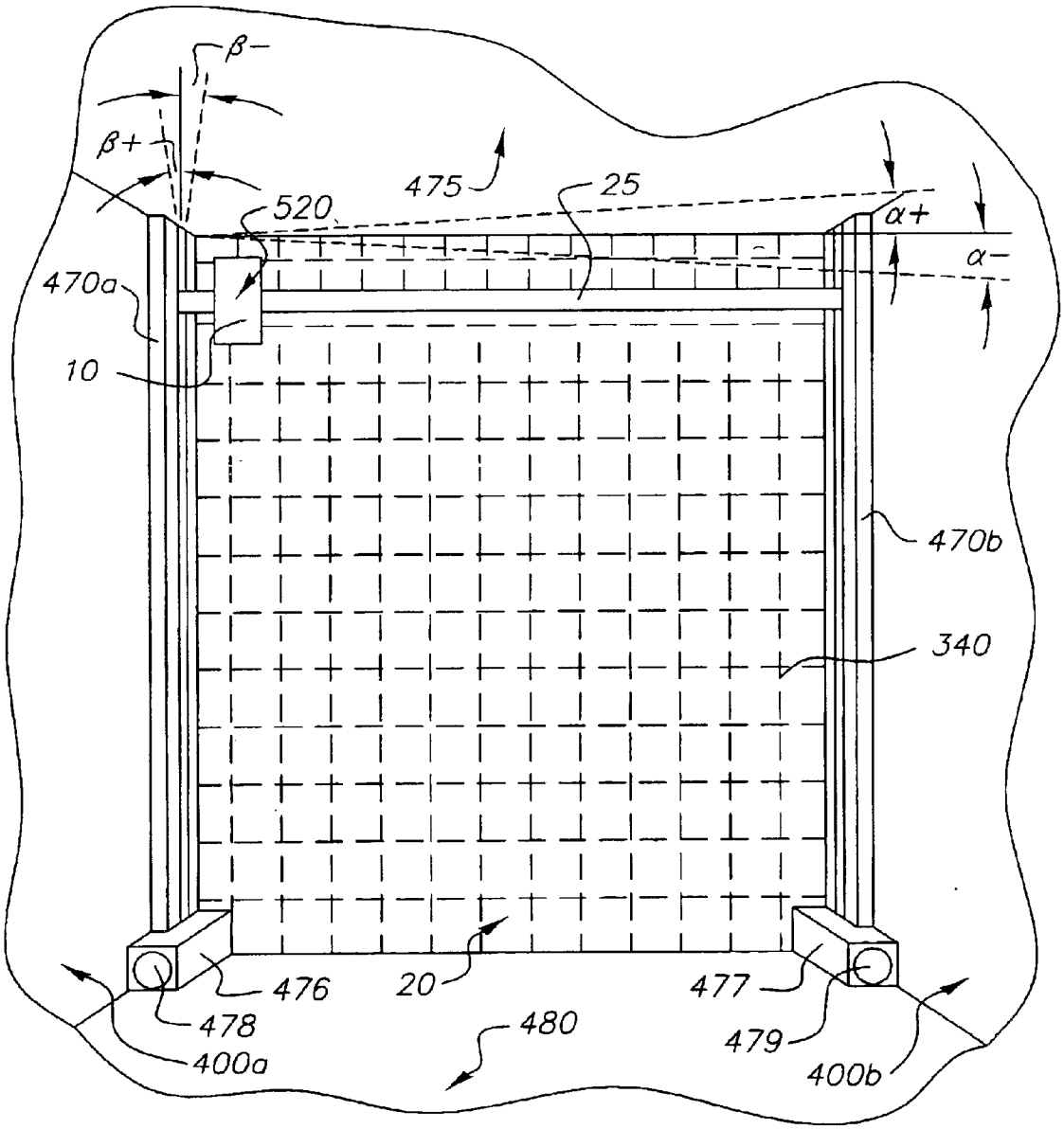
FIG. 10*a* is an elevation view of the printing apparatus, depicting horizontal and vertical alignment of the image according to a described method during printing, when there are irregularities between a ceiling, a wall, and the floor.
Figure 10B:
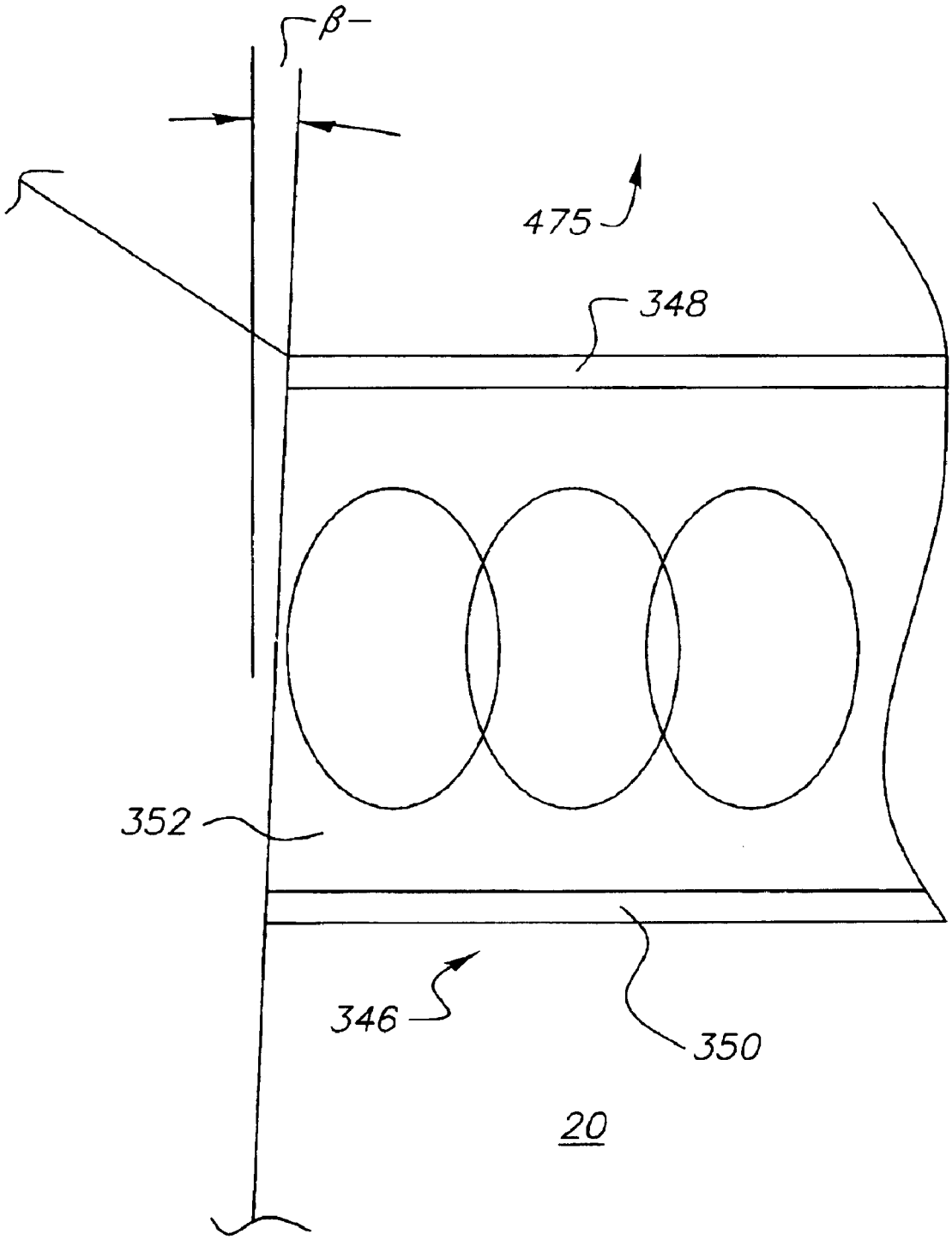
FIG. 10*b* further depicts the method as in FIG. 10*a;*
Figure 10C:
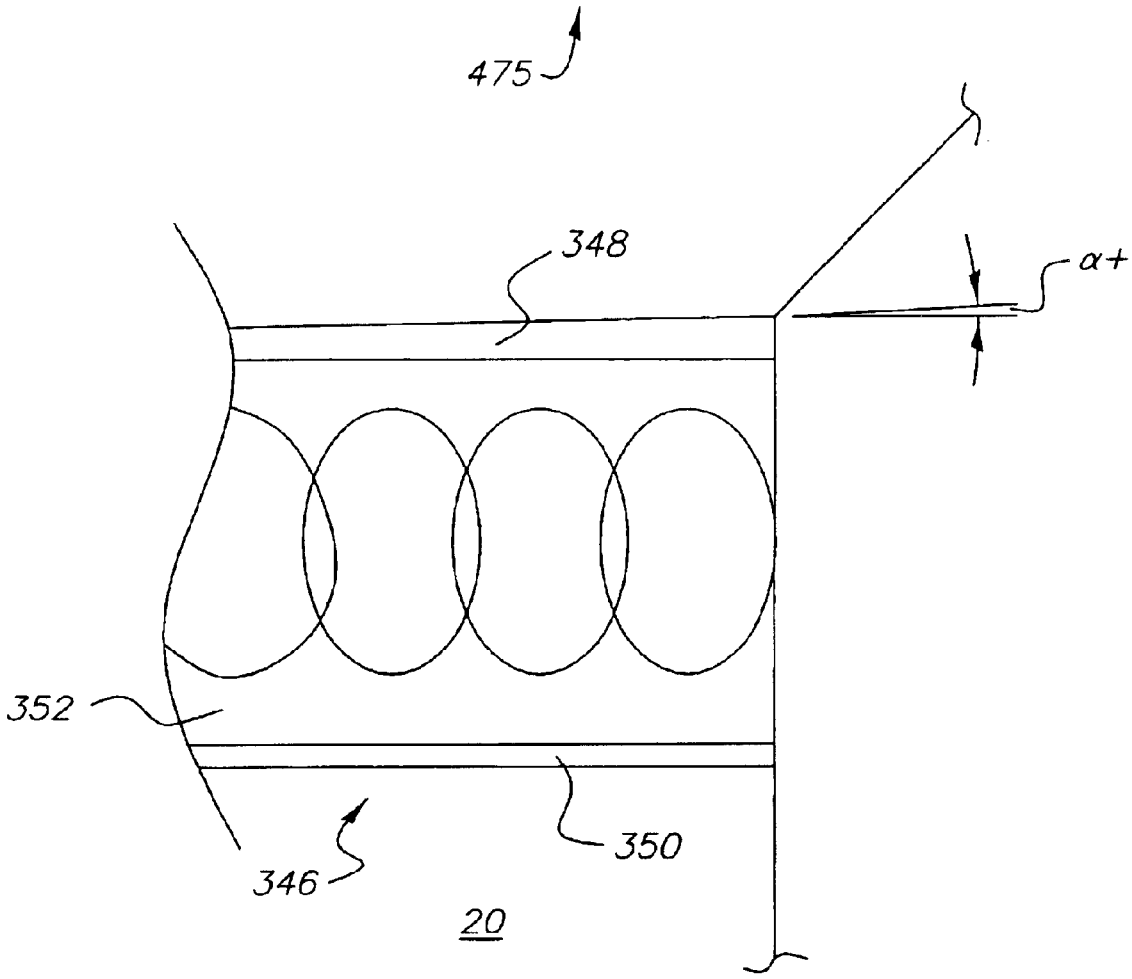
FIG. 10*c* depicts a variation of the method as compared to FIG. 10*b;*
Figure 10D:
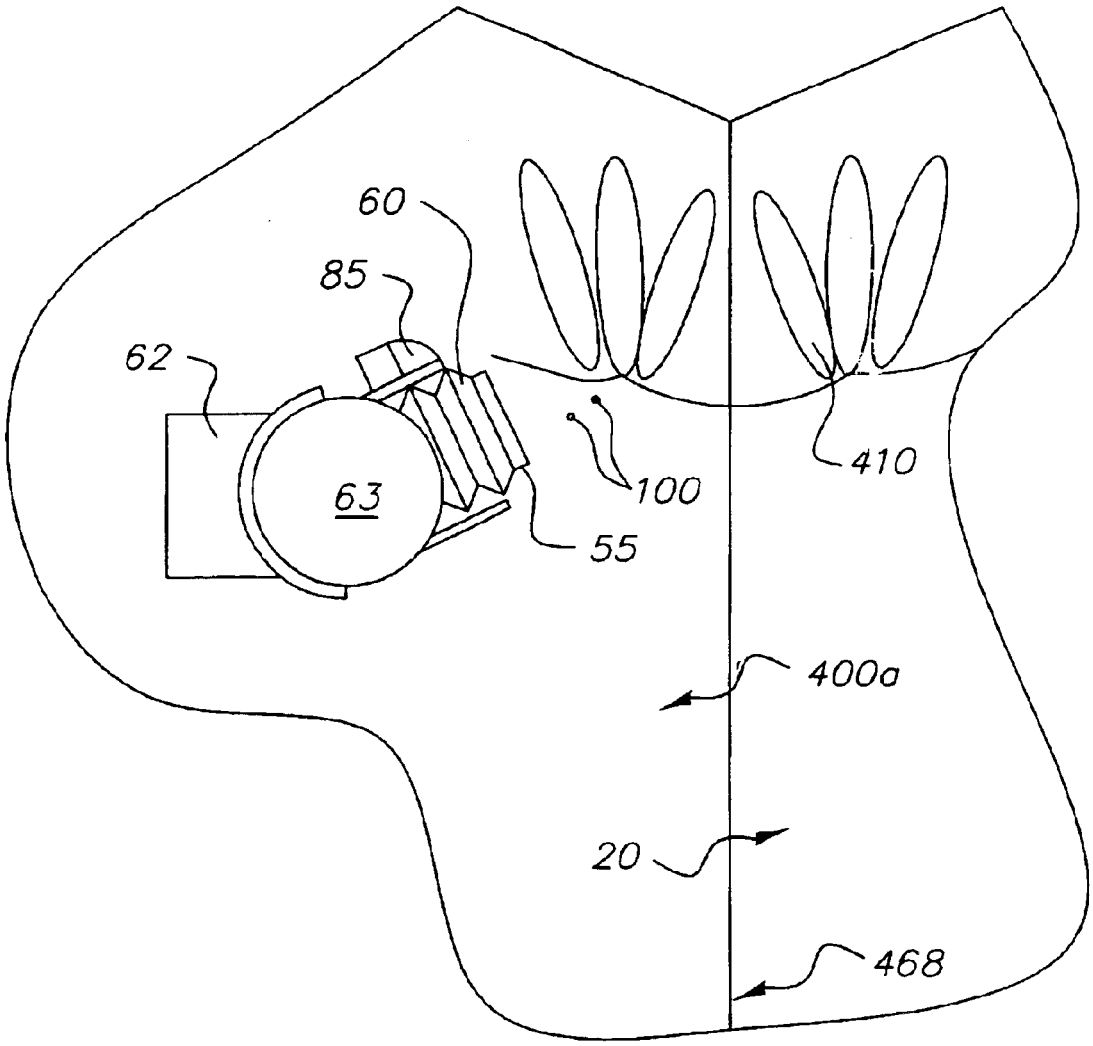
FIG. 10*d* is an elevation view of the printing apparatus, depicting printing at a corner between adjacent walls.

In FIG. 2*b*, the sensor 85 is positioned parallel to the z-axis 65*a* to be aimed at the selected surface, to be in sensing relationship to the selected surface 20 for sensing the distance to successive points on the selected surface including sensing surface variations on the selected surface such as the corner 468 in FIG. 10*d* and the contoured area 506 in FIG. 7*d*. When the sensor 85 senses the distance to a particular point on the selected surface 20, it sends a signal via the logic, control and memory unit 75 to the z-axis telescoping mechanism 60 and the rotating mechanism 62. The telescoping mechanism 60 and the rotating mechanism 62 move the print head 55 as indicated by the arrows 65*a*, 65*b*, and 65*c*, maintaining a constant distance between the print head 55 and the selected surface 20 to cause the marking solution 100 to be uniformly applied to the selected surface.

Figure 2C:
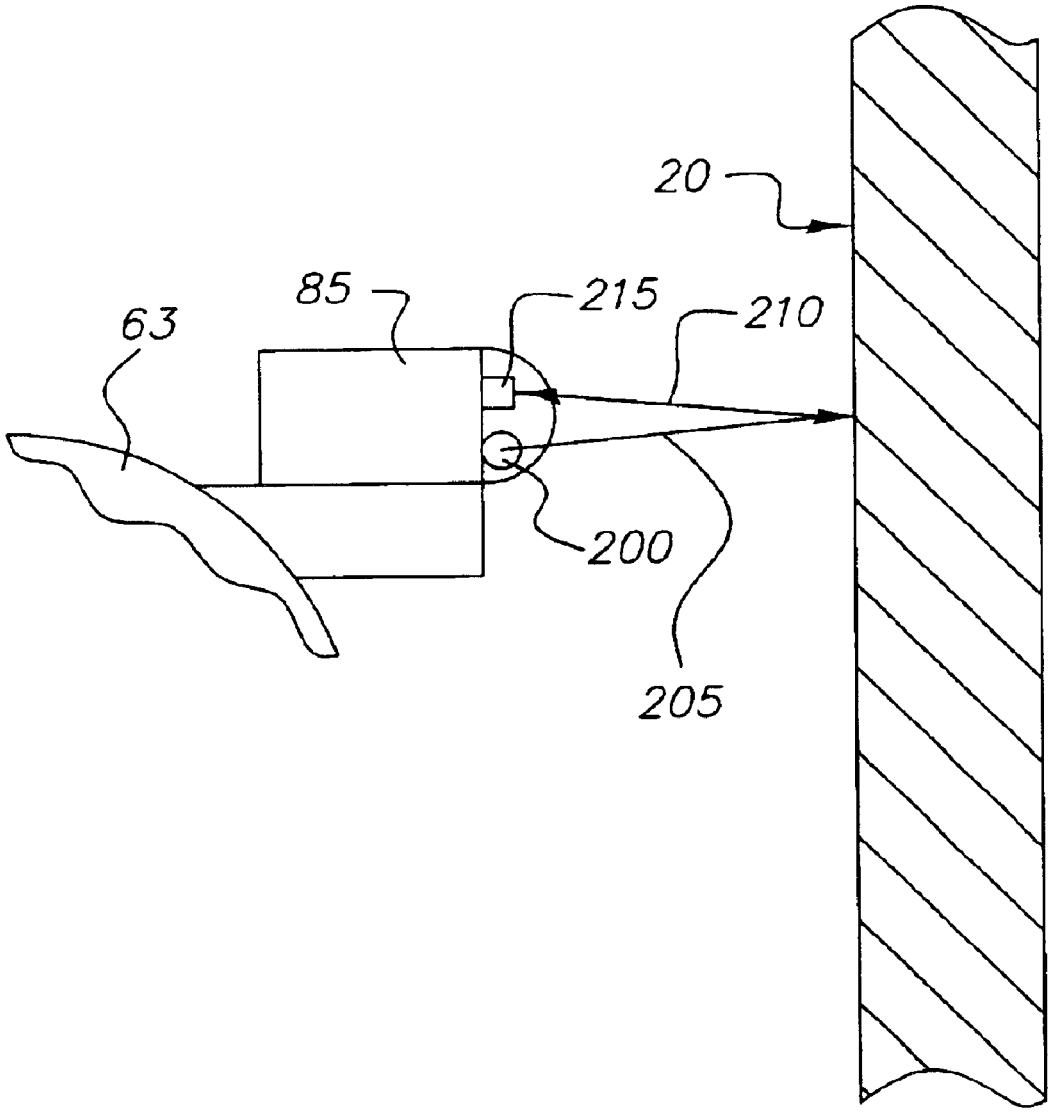
FIG. 2*c* is an elevation view of the sensor.

In FIG. 2*c* the sensor 85 is shown as a laser system comprising a photodiode light source 200 capable of emitting a laser light beam 205 to be intercepted by the selected surface 20 and reflected therefrom to define a reflected light beam 210. In such a laser system, the sensor 85 has a light detector 215, which may be a CCD (Charged Couple Device) associated with a light source 200 for detecting reflected light beam 210. It should be appreciated that the sensor 85 and the print head 55 need not be pointing at the same point on the selected surface 20 as long as the initial position of the sensor relative to the initial position of the print head 55 is established at the start of a mapping process. Alternatively, to determine the distance to the selected surface 20, the guide finger 90 can be used as a mechanical follower such as a telescoping spring-loaded follower 150 having an end portion 155 (e.g., a rollable ball bearing) that is adapted to contact the selected surface and follow there along. See FIG. 2*a*.

Figure 3A:
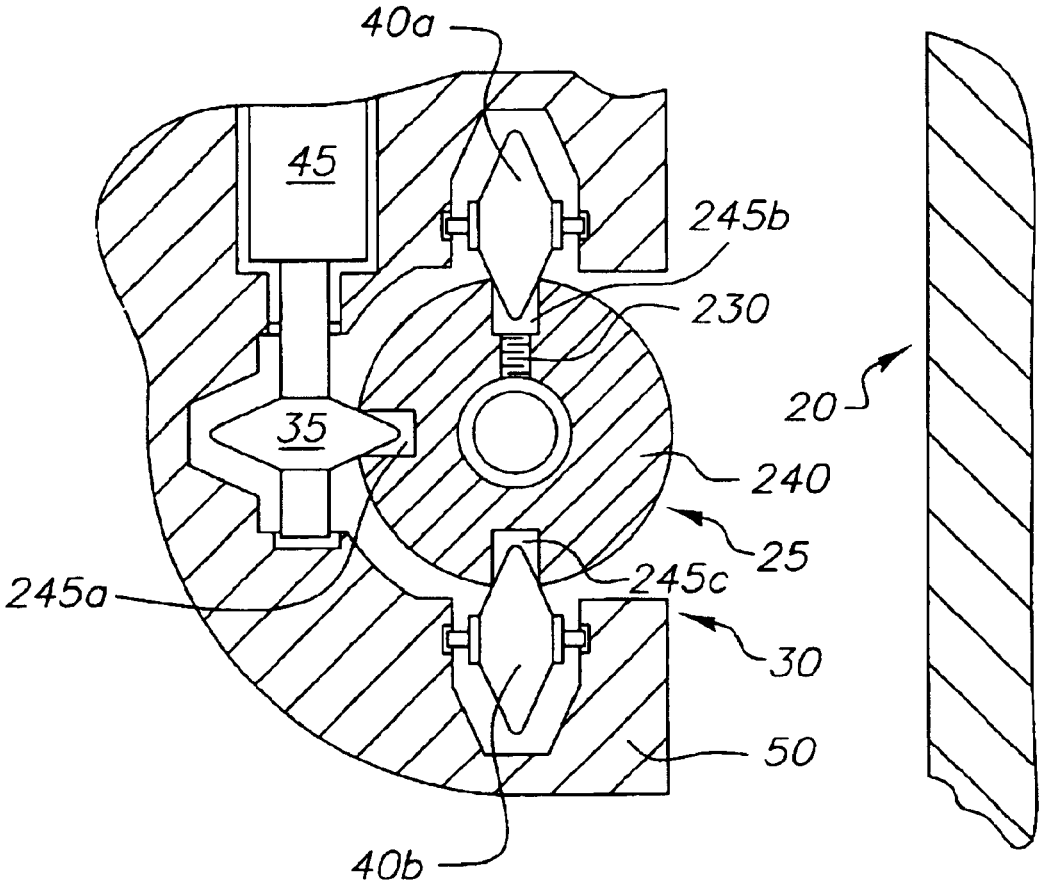
FIG. 3*a* is an elevation view of an x-axis support for the print head in the printing apparatus.

FIG. 3*a* shows the x-axis horizontal member 25 and the propulsion assembly 30. As previously discussed in connection with FIG. 1 like numerals indicate like parts and operations. The x-axis horizontal member 25 is a cylindrical rod 240 with three channels 245*a*, 245*b*, and 245*c* and a locking set screw 230. The a propulsion assembly 30 consisting of the drive wheel 35 driven by the stepper motor 45 and the pair of guide wheels 40*a* and 40*b* each with an encoder not shown, ride in respective channels 245*a*, 245*b*, and 245*c* which allow the marking engine 10 to be positioned adjacent to the selected surface 20. Also, this provides a rigid structure which holds the marking engine 10 in an exact relationship to the selected surface 20—while the marking engine 10 is free to move horizontally right and left along the x-axis as indicated by the double-head arrow 115 in FIG. 1.

Figure 3B:
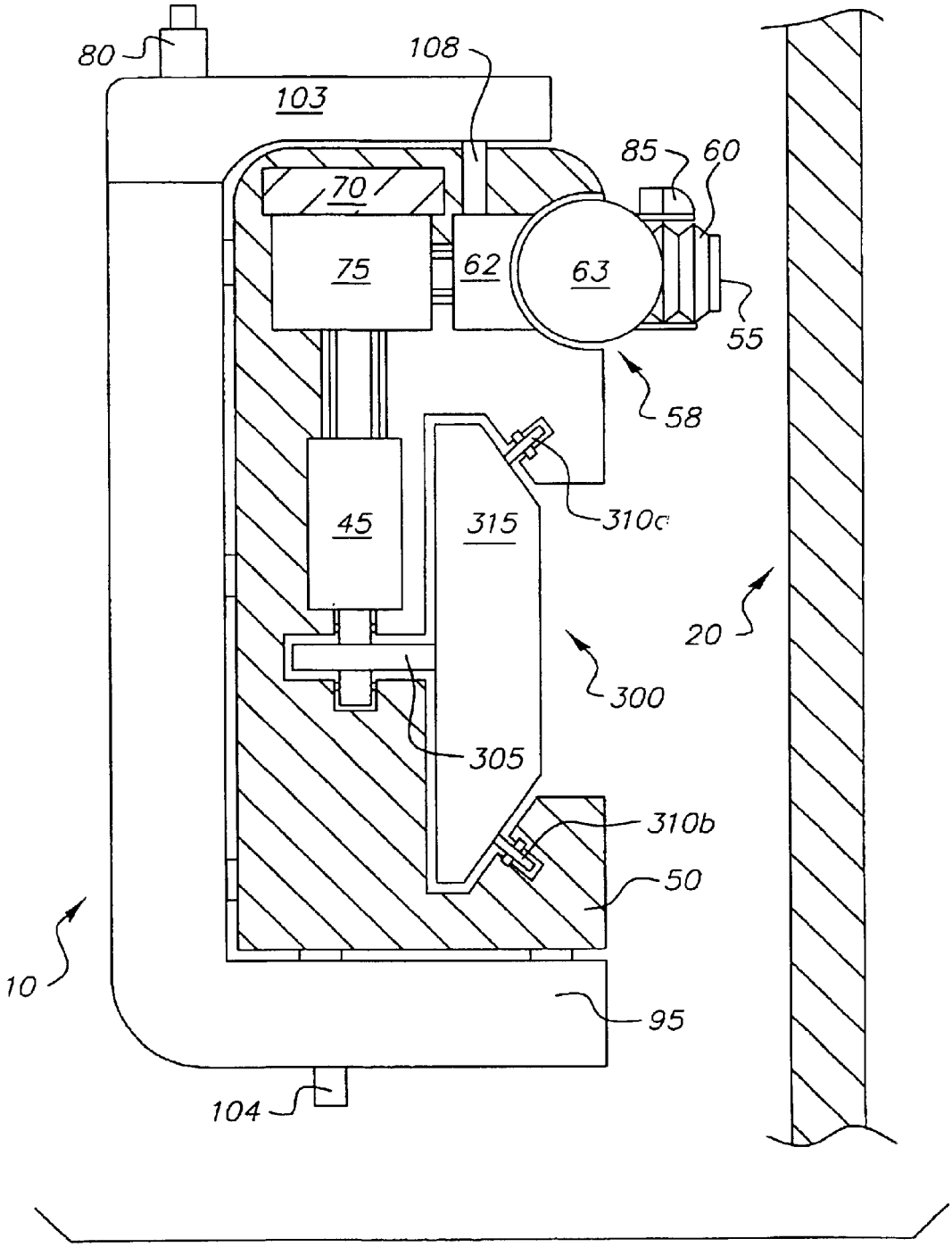
FIG. 3*b* is an elevation view of an alternate embodiment of the printing apparatus.

FIG. 3*b* illustrates another embodiment of the marking engine 10. As previously discussed in FIG. 1 like numerals indicate like parts and operations. The marking engine 10 comprises the print head 55, a propulsion assembly 300 consisting of a drive wheel 305 driven by the stepper motor 45 and two guide wheels 310*a* and 310*b* each with an encoder not shown. In this embodiment, a trapezoid shaped horizontal member 315 is allows the marking engine 10 to be positioned adjacent to the selected surface 20 and provides a rigid structure which holds the marking engine 10 in an exact relationship to the selected surface 20—while the marking engine 10 is free to move horizontally right and left along the x-axis as indicated by the double-head arrow 115 in FIG. 1.

Figure 4:
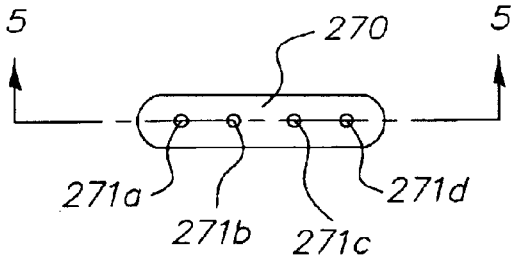
FIG. 4 is a plan view of a nozzle plate on the print head.

In FIG. 4 the print head 55, which in this embodiment is a DOD inkjet print head, comprises a plate 270 having a plurality of nozzles 271*a*, 271*b*, 271*c*, and 271*d*. As previously discussed in FIG. 1 like numerals indicate like parts and operations. When a voltage is applied to piezoelectric transducers 287*a*, 287*b*, 287*c*, and 287*d* (see FIG. 5.) a drop 288 of a marking solution 250*a*, 250*b*, 250*c*, and 250*d* is ejected from each nozzle 271*a*, 271*b*, 271*c*, and 271*d* and onto the selected surface 20.

Figure 5:
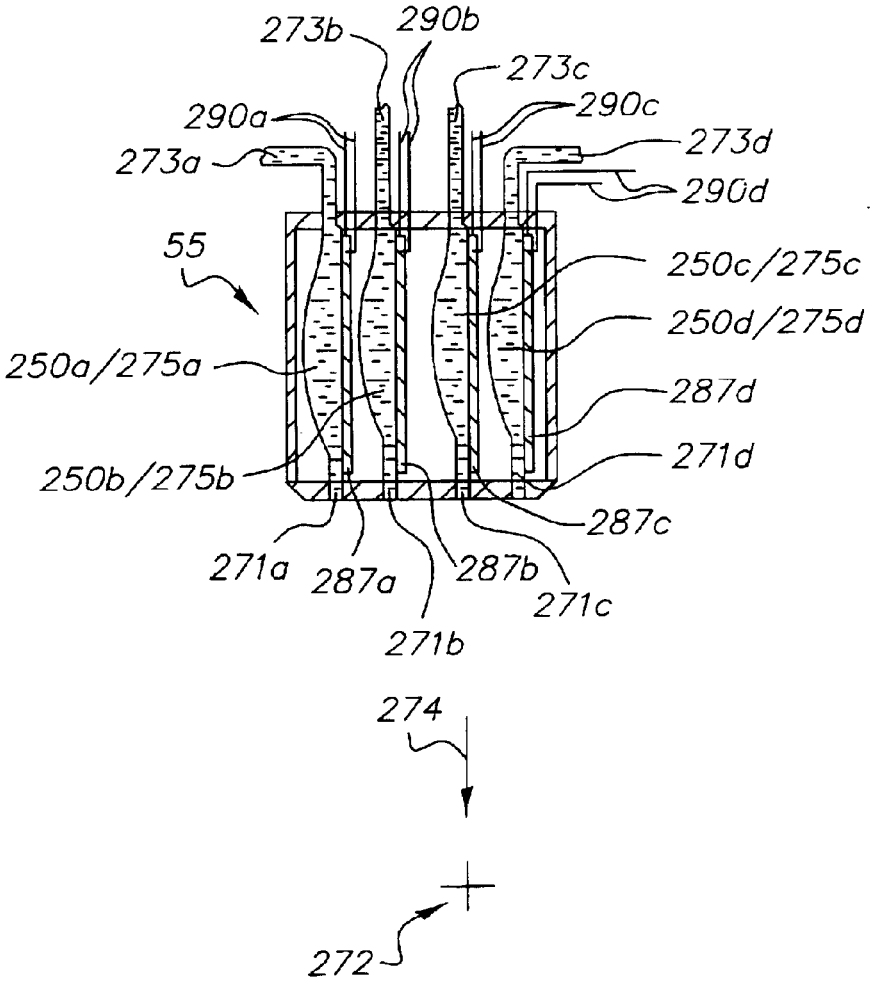
FIG. 5 is a cross-sectional view as seen in the direction of the arrowed line 5—5 in FIG. 4.

In FIG. 5, the nozzles 271*a*, 271*b*, 271*c*, and 271*d* can be seen connected to channel-shaped chambers 275*a*, 275*b*, 275*c* and 275*d*. The chambers 275*a*, 275*b*, 275*c* and 275*d* are in communication with the reservoir 95 via tubing lines 273*a*, 273*b*, 273*c*, and 273*d* respectively. As previously discussed there maybe more than one reservoir containing the marking solutions 250*a*, 250*b*, 250*c*, and 250*d*, for example cyan, magenta, yellow and black. The marking solutions flow through the tubing lines 273*a*, 273*b*, 273*c*, and 273*d* and into the chambers 275*a*, 275*b*, 275*c* and 275*d*. In addition, each of the nozzles 271*a*, 271*b*, 271*c*, and 271*b* defines a nozzle orifice 281*a*, 281*b*, 281*c*, and 281*d* communicating with the respective chambers 275*a*, 275*b*, 275*c* and 275*d*.

Figure 6:
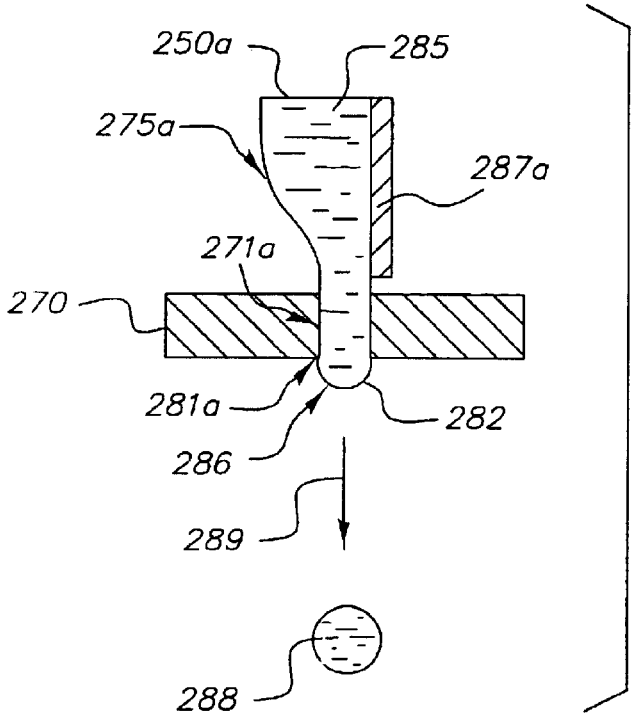
FIG. 6 is a sectional view of a nozzle on the print head.

FIG. 6 shows an enlargement of the nozzle 271*a* in FIG. 5. As the marking solution flows into the chamber 275*a* a marking solution body 285 is formed. A marking solution meniscus 282 is disposed at an orifice 281*a* when the marking solution body 285 is disposed in the chamber 275*a*. As shown, the marking solution meniscus 282 has a surface area 286. By way of example, the orifice 281*a* may have a radius in the range of approximately 20 to 60 $\mu$m.

Referring now to FIGS. 4, 5, and 6, when a voltage is applied to the piezoelectric transducers 287*a*, 287*b*, 287*c*, and 287*d*, a drop 288 of the marking solution 250*a*, 250*b*, 250*c*, and 250*d* is ejected from the nozzles 271*a*, 271*b*, 271*c*, and 271*d* in the direction of an arrow 274.

In FIG. 5, the nozzles 271*a*, 271*b*, 271*c*, and 271*d* are pointed at the same spot 272 so that varying colors can be created with a single pass of the print head 55. The marking engine 10 may comprise more than one print head 55. The controls for the multihead print head can also be programmed to provide for color marking of adjacent spots or spots somewhat spaced from each other. The multiple colors for a pixel may not exactly overlap but can have some overlap or else a close positioning relative to each other. The print head 55 is capable of marking in any number of colors including the complementary color sets such as cyan, magenta, and yellow.

Figure 8:
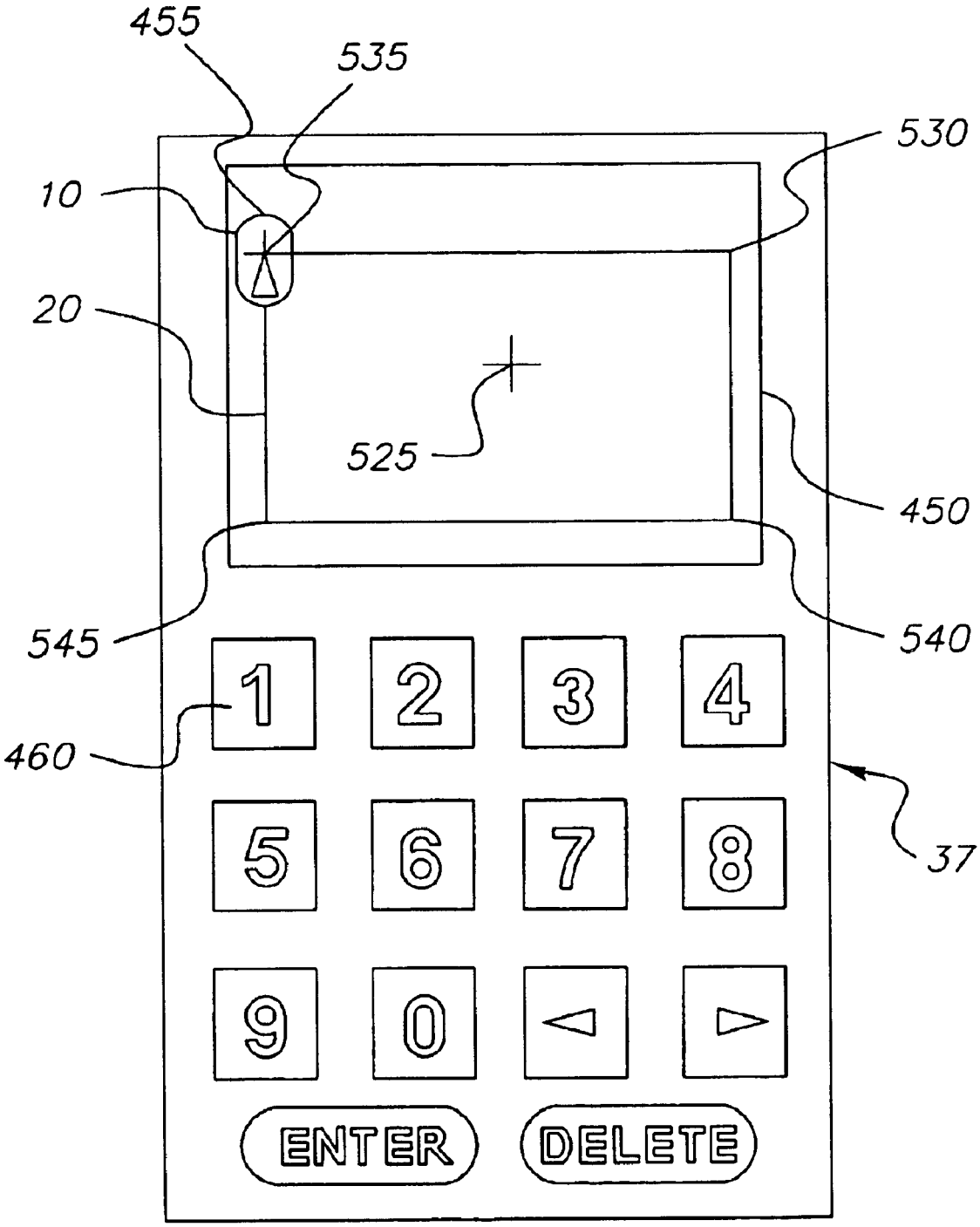
FIG. 8 is an elevation view of an input panel on the printing apparatus.
Figure 9A:
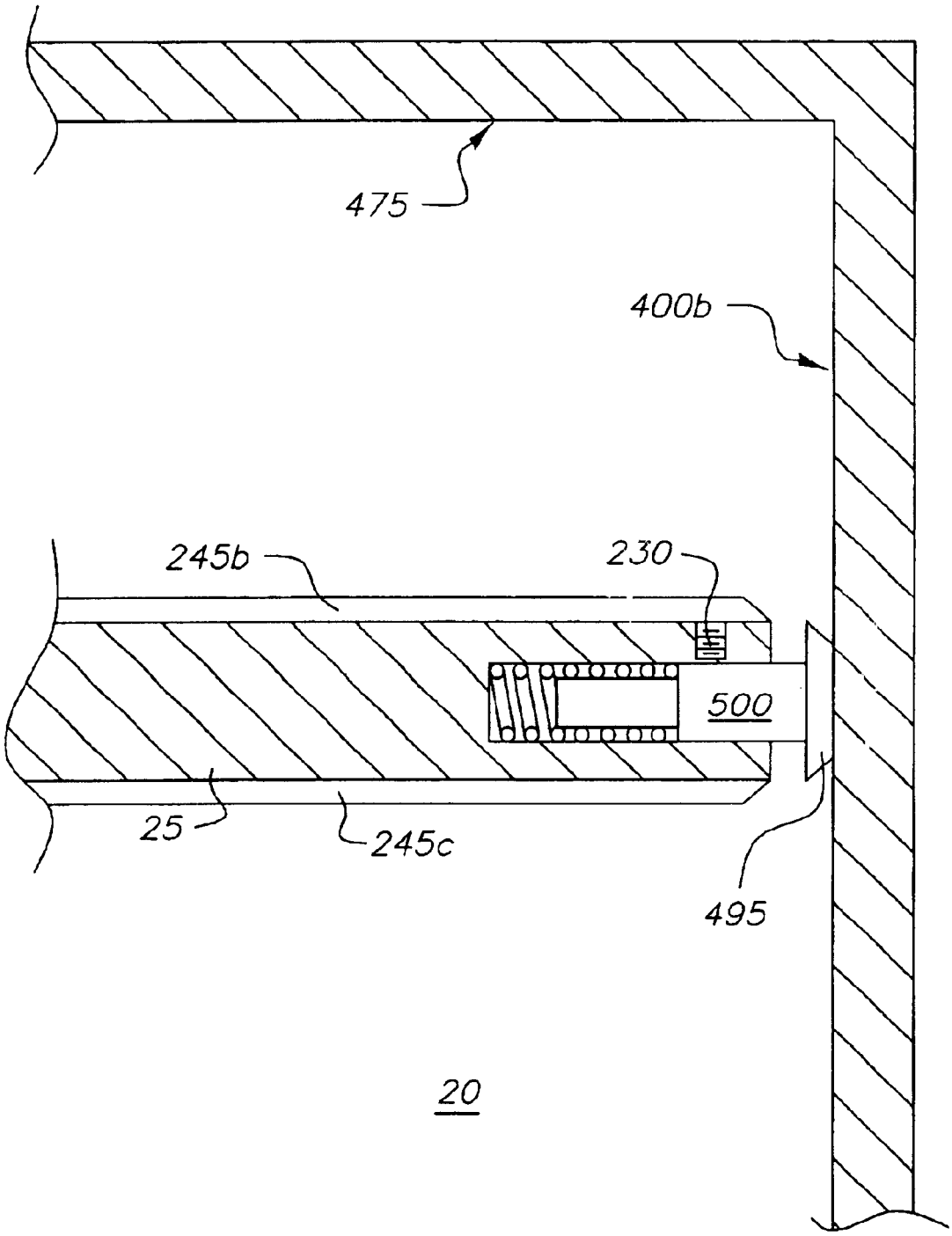
FIG. 9*a* is an elevation view of the x-axis support for the print head.
Figure 9B:
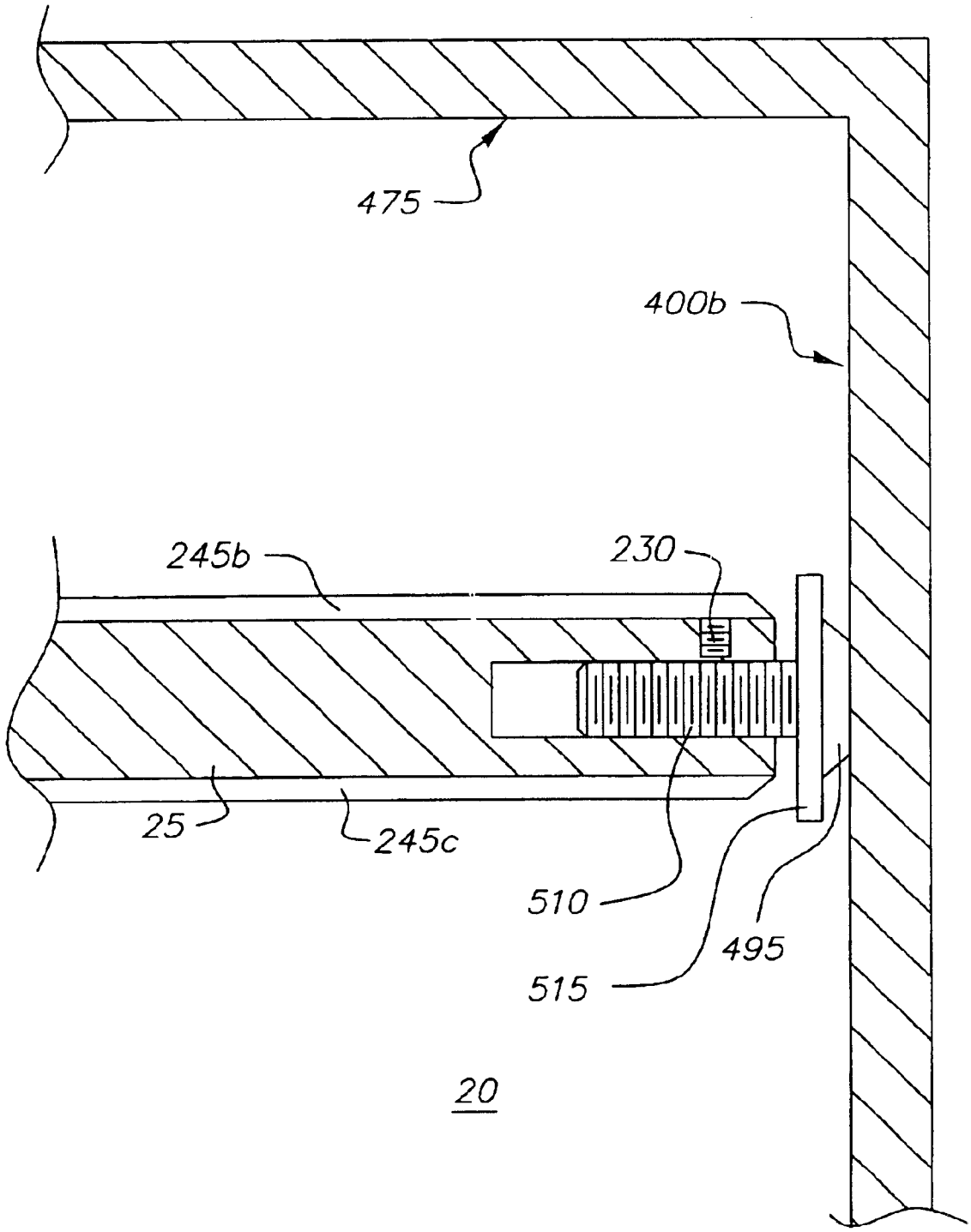
FIG. 9*b* is an elevation view of a variation of the x-axis support for the print head shown in FIG. 9*a;*
Figure 9C:
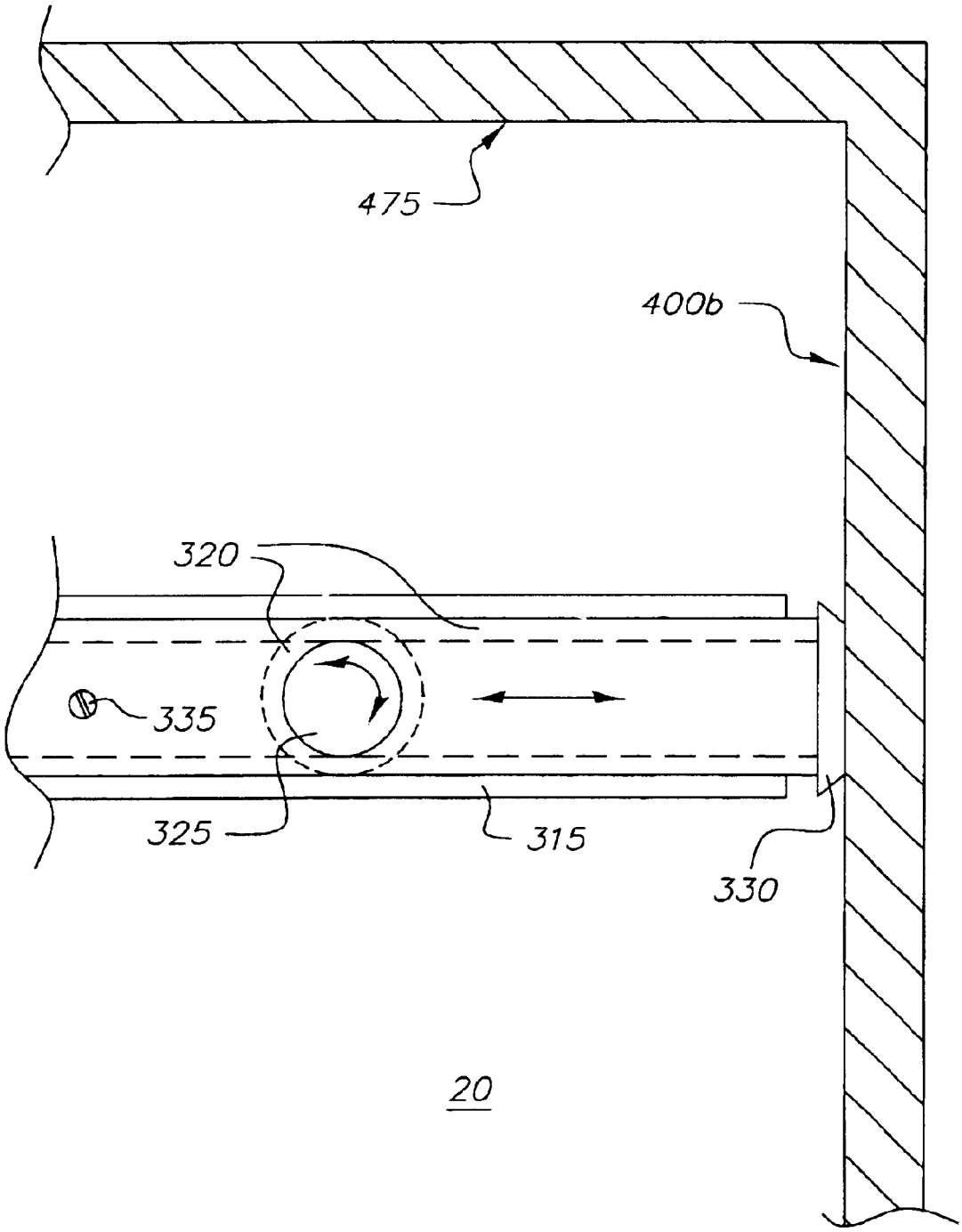
FIG. 9*c* is an elevation view of a variation of the x-axis support for the print head shown in FIG. 9*a;*

Referring now to FIG. 7*a*, the marking engine 10 translates along on the x-axis horizontal guide member 25, which in turn is supported by the adjacent walls 400*a* and 400*b* as indicates alternatively in FIGS. 9*a*, 9*b*, and 9*c*. As previously discussed in FIG. 1 like numerals indicate like parts and operations. The printing apparatus 5 is controlled by the logic and control unit 75, which receives directions from the input panel 37 (see FIG. 8) and image data from an external memory source such as a computer not shown, from the communication device 80 such as an RF receiver and transmitter, from an internal memory source such as the EPROM 105, inserted into the EPROM slot 110 or from the logic and control unit 75 itself. The logic and control unit 75 is in communication with the marking engine 10 and the print head 55 via lines 290*a*, 290*b*, 290*c*, and 290*d* shown in FIG. 5. Using the nozzles 271*a*, 271*b*, 271*c*, and 271*d*, the marking engine 10 can create an image 410 which may be in color on the selected surface 20.

Referring now to FIG. 7*b*, the marking engine 10 translates along the x-axis the horizontal member 25 as indicated by the double-head arrow 115. The x-axis horizontal member is translated up and down in y-axis tracks or supports 470*a* and 470*b* along a y-axis perpendicular to the x- and z-axes 115 and 65*a* as indicated by a double-head arrow 465. As is known, the x-axis 115 and the y-axis 465 are perpendicular to one another and are in the same plane. The z-axis 65*a* is in a plane perpendicular to the plan of the x- and y-axes. The x-axis horizontal member 25 is moved by track drivers 476 and 477 comprised of track stepper motors 478 and 479. The stepper motors 478 and 479 may drive a wire and pulley assembly not shown or a lead screw mechanism also not shown which are internal to the y-axis tracks 470*a* and 470*b* and are know. The tracks 470*a* and 470*b* are fastened to the ceiling 475 and the floor 480 by the mechanisms alternatively shown in FIGS. 9*a*, 9*b*, and 9*c* and are supported by the adjacent walls 400*a* and 400*b* respectively and by the ceiling 475 and the floor 480 as shown in FIG. 10*a*. As previously discussed in FIG. 1 like numerals indicate like parts and operations. The printing apparatus 5 is controlled by the logic and control unit 75, which receives directions from the input panel 37 (see FIG. 8) and image data from an external memory source such as computer not shown, from the communication device 80 such as an RF receiver and transmitter, from an internal memory source such as the EPROM 105, inserted into the EPROM slot 110 or from the logic and control unit 75 itself. The logic and control unit 75 is in communication with the marking engine 10 and the print head 55 via lines 290*a*, 290*b*, 290*c*, and 290*d* shown in FIG. 5. Using the nozzles 271*a*, 271*b*, 271*c*, and 271*d*, the marking engine 10 can create an image 490 which may be in color on the selected surface 20.

Figure 7C:
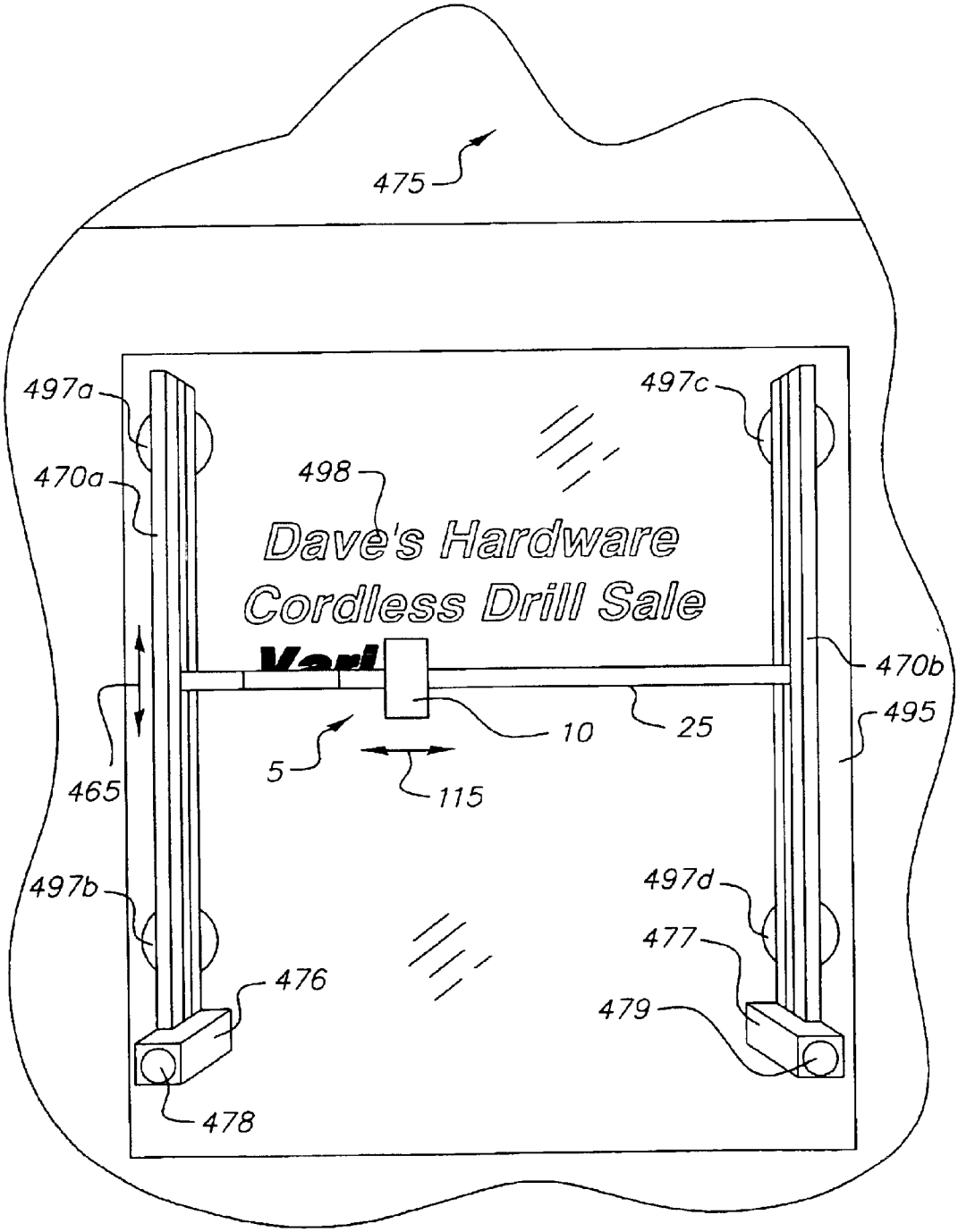
FIG. 7*c* is a perspective view depicting how the printing apparatus prints an image on a glass surface.

Referring to FIG. 7*c*. there is illustrated yet another embodiment. In this embodiment the printing apparatus 5 is used to mark on a glass surface 495 such as a store window. The marking engine 10 is translated along the x-axis horizontal member 25 as indicated by the double-head arrow 115. The x-axis horizontal member 25 is translated up and down up and down in y-axis tracks 470*a* and 470*b* as indicated by the double-head arrow 465. The track drivers 476 and 477 as previously described in FIG. 7*b* move the x-axis horizontal member 25 along the y-axis 465. The tracks 470*a* and 470*b* are fastened to the glass surface 495 by suction devices 497*a, b, c*, and *d*. The use of suction devices is well know. As previously discussed in regard to FIGS. 1 and 7*b* like numerals indicate like parts and operations. The logic and control unit 75 as previously discussed controls the printing apparatus 5, and is in communication with the marking engine 10 and the print head 55 as shown in FIG. 5. The marking engine 10 can create an image 498 which may be in color on the glass surface 495.

Referring to FIG. 7*d*, there is illustrated yet another embodiment. In this embodiment the printing apparatus 5 is used to mark on a curved wall 502 on which the selected surface 20 constitutes spaced flat areas 503 and 504 separated by a contoured area 506. The marking engine 10 is translated along the x-axis on the horizontal member 25 as indicated by the double-head arrow 115. The x-axis horizontal member 25 is translated up and down in y-axis tracks 470*a* and 470*b* as previously discussed. As previously discussed in FIGS. 1 and 7*b* like numerals indicate like parts and operations. The logic and control unit 75 as previously discussed controls the printing apparatus 5, and is in communication with the marking engine 10 and the print head 55 as shown in FIG. 5. The marking engine 10 can create an image on the curved wall 502 by translating in and out (forward and rearward) along the z-axis as indicated by the double-head arrow 505. As the marking engine 10 moves across the curved wall 502 the print engine 55 maintains its distal relationship to the wall surface 20 by means of the positioning mechanism 58 comprising the telescoping mechanism 60.

To prepare the selected surface 20 for printing, an application of an image-receiving layer (not shown) may be required in order to promote adhesion of image 410 to the selected surface. In the case where the selected surface is a wall, or some other large vertical surface area, the image-receiving layer can be a solution that is applied with a paintbrush, roller, spray, or some other known means. There are many suitable compositions for the image receiving layer, one such composition is a blend of poly(ethylene oxide), 60 percent by weight, and carboxymethyl cellulose, 40 percent by weight, which blend was present in a concentration of 10 percent by weight in water. Another composition comprises up to 50% by weight of a vinylpyridine/vinylbenzyl quaternary salt copolymer and a hydrophilic polymer selected from the group consisting of gelatin, polyvinyl alcohol, hydroxypropyl cellulose and mixtures thereof. In addition, an adhesion-promoting layer may be required to aid in the adhesion between the surface and the image-receiving layer.

It should also be understood that the image-receiving layer can also include such addenda as ultraviolet absorbers, antioxidants, surfactants, humectants, bacteriostat and cross-linking agents. It may also be desirable to add a colorant such as a color that is predominant in the background. The colorant may be a dye, pigment etc.

Referring to FIG. 8, the input panel 37 comprises a display 450, which via a fiducial 455 shows the position of the marking engine 10 in relation to the select surface 20, for example the starting position 520 which may be center 525, a top right 530, a top left 535, a lower right 540, or a lower left 545 position, and a keyboard 460 for inputting instructions. The display 450 may be a touch screen.

Referring to FIG. 9*a*, the end portion of the x-axis horizontal member 25 is a spring-loaded shaft 500 with a rubber foot 495. This is duplicated at the opposite end of the x-axis horizontal member 25. The spring-loaded shaft 500 with the rubber foot 495 presses against the wall 400*b*. The x-axis horizontal member 25 is leveled using known methods for leveling such s with a bubble level. Then, the x-axis horizontal member 25 is locked in place by the set screw 230.

In a variation shown in FIG. 9*b* the x-axis horizontal member 25 is held in place by a threaded foot 510, which is turned in or out via a knurled knob 515. By turning the knurled knob 515 the rubber foot 495 is forced against the wall 400*b*.

In a variation shown in FIG. 9*c* the trapezoid shaped horizontal member 315 is held in place by a rack and pinion gear mechanism 320, which is turned in or out via a removable knurled knob 325. By turning the knurled knob 325 the rubber foot 330 is forced against the wall 400*b*. Then, the x-axis horizontal member 315 is locked into place by tightening the locking screw 335.

FIGS. 10*a*, 10*b*, and 10*c* shown a method for compensating for misalignment between the ceiling 475 and the selected surface 20, which in this instance is a wall. To determine whether or not the ceiling 475 is misaligned (not parallel to the floor, or not a true horizontal), a mapping process is undertaken and is described in more detail with respect to FIGS. 11*a*, 11*b*, and 11*c*. Suffice it to say that in the preferred embodiment for printing borders, it is desirable to create a border that is substantially parallel with the floor (at a true horizontal). The mapping process of FIGS. 11*a*, 11*b*, and 11*c* described below shows the method for creating a three-dimensional grid map 340. The three-dimensional grid map 340 produces lines that are substantially orthogonal in x, y, z directions. In a perfectly constructed room, the three-dimensional grid map 340 would map perfectly parallel to the wall 20, the ceiling 470, and the floor 480. In reality, the wall 20 is only substantially perpendicular to the ceiling 470 and the floor 480 so that deviations by a few degrees off the orthogonal map are common. These deviations are illustrated as angles $\alpha+$ and $\alpha-$ in FIG. 10*a*. Similarly, the wall 400*a* and the wall 20 deviate from the orthogonal by angles $\beta+$ and $\beta-$ in FIG. 10*a*. To compensate for such deviations, it is desirable for the printing apparatus 5 to first measure the deviations by the mapping process of FIGS. 11*a*, 11*b*, and 11*c* and then adjust the printing appropriately.

In a first embodiment of a method for compensating for misalignment of ceilings to walls, FIG. 10*b* illustrates the use of measured angle $\beta-$. In this embodiment, the printing apparatus 5 is controlled to deliver a parallel border 346, which is comprised of parallel edge areas 348 and 350 and a central pattern area 352. To accomplish this, the printing apparatus 5 is controlled as previously discussed to permit the printing of the border 346 to follow the line of the ceiling maintaining the dimensions of the edge areas 348 and 350. The compensation of angle $\beta-$ causes the printing of the border 346 along one wall 20 to form a parallelogram by incorporating the angle $\beta-$. It should be noted that pattern area 352 is not distorted by angle $\beta-$. Rather, the repeating pattern is effectively "trimmed" by the angle $\beta-$.

In a second embodiment of a method for compensating for misalignment of the ceiling 470 to the wall 20, it is desirable to maintain a border 346 that is level (matching the orthogonal direction of map 340). In the illustration of FIG. 10*c*, a border 346 is shown with edge areas 348 and 350 wherein angle $\alpha+$ has been calculated and the edge area 348 expanded by angle $\alpha+$ to follow the ceiling line while maintaining the edge area 350 aligned with map 340. The slight angular expansion of the edge area 348 is not terribly noticeable and permits the bottom of the border 346 to match the orthogonal line of the map 340 while following the line of the ceiling 470 as it deviates from the orthogonal by angle $\alpha+$.

Referring to FIG. 10*d*, the sensor 85 is disposed in sensing relationship to the wall 20 and for sensing adjacent wall 400*a* to determine the position of the corner 468. As the sensor 85 senses the position of the corner 468, the sensor 85 generates a contour map corresponding to the position of the corner 468 sensed thereby, as described more fully in FIGS. 11*a* and 11*b*. The working relationship between the sensor 85 and print head 55 has been previously described in FIG. 2*b*. It should be appreciated that the sensor 85 and the print head 55 need not be pointing at the same location on the surfaces 20 and 400*a* as long as the position of the sensor relative to the position of the print head 55 is known at the start of the mapping process. Connecting the print head 55 to the positioning mechanism 58 allows the distance between the print head and the surfaces 20 and 400*a* to be held constant by adjustment of the amount of the telescoping mechanism 60 and the rotating mechanism 62. Maintaining constant distance between the print head 55 and the surfaces 20 and 400*a* allows the marking solution 100 (e.g., colored ink) to be uniformly applied around the corner 468 maintaining the continuity of the image 410 in the transition from the surface 20 to the surface 400*a*.

Figure 11A:
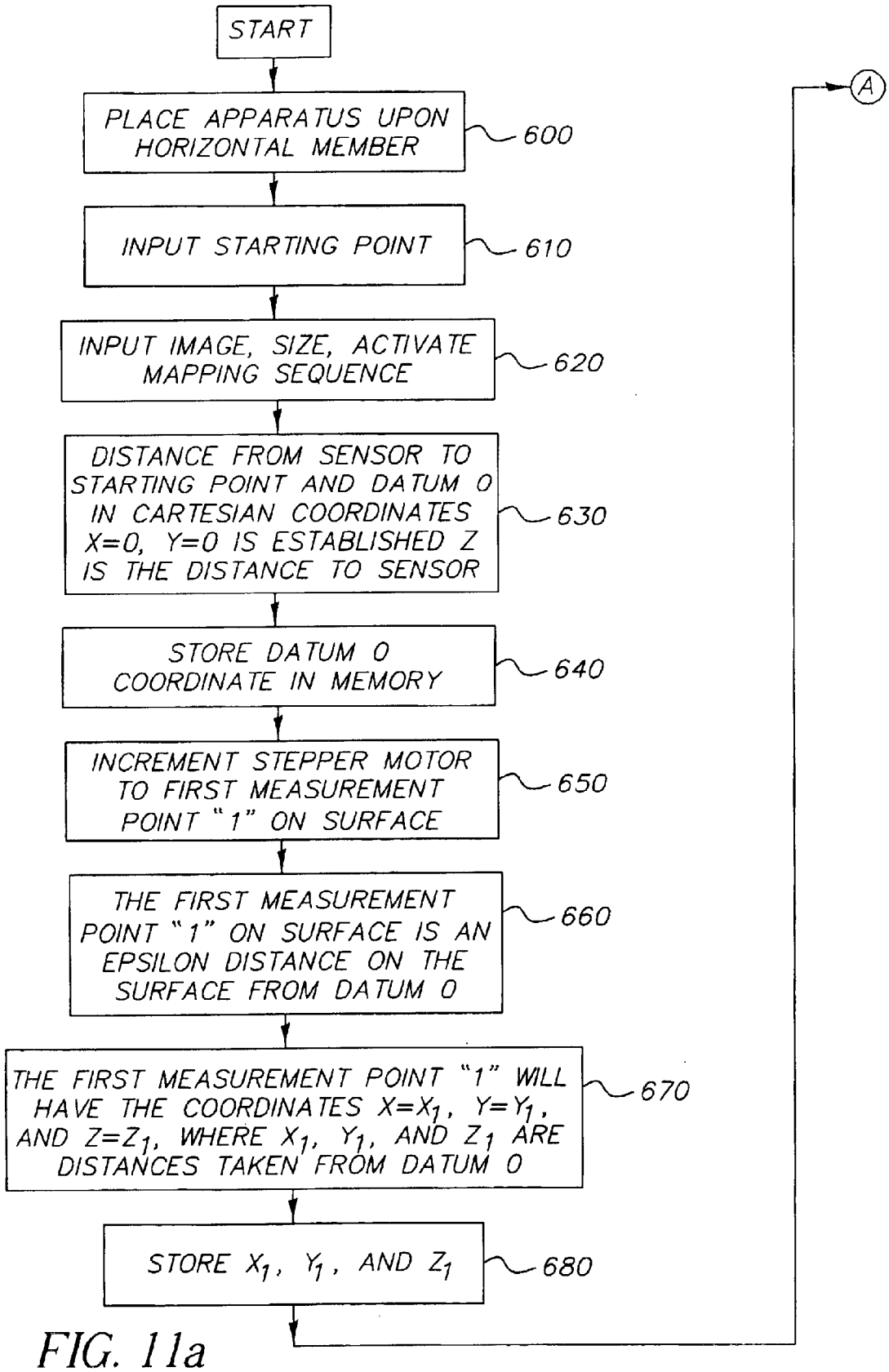
FIGS. 11*a*, 11*b* and 11*c* are logic flow-charts of a method for mapping an image onto a selected surface.
Figure 11B:
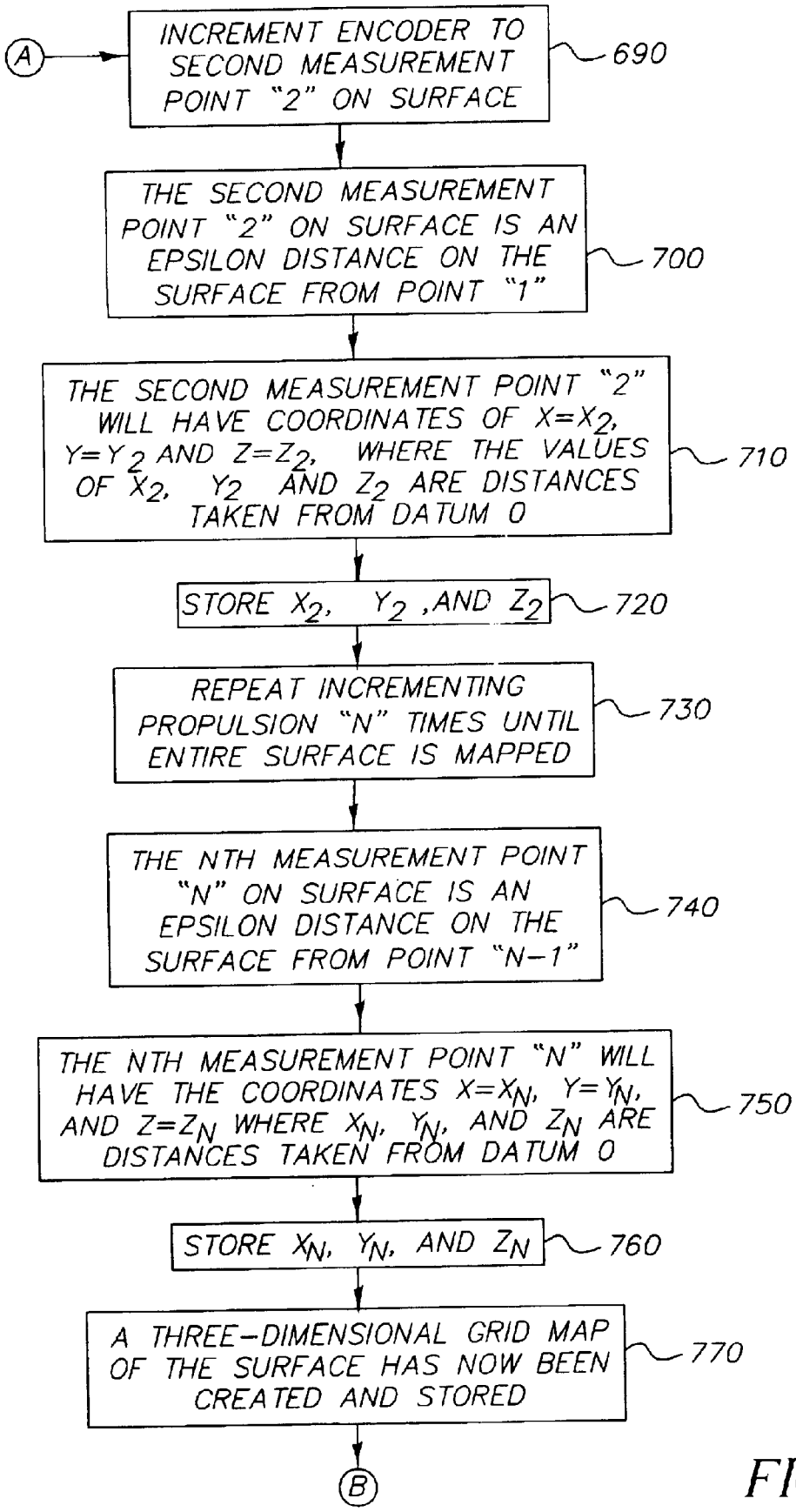

Now referring to FIGS. 11*a*, 11*b*, and 11*c* the manner in which the selected surface 20 is mapped into x, y and z coordinates will be described. First, the x-axis horizontal member 25 and the y-axis tracks 470*a* and 470*b* are assembled adjacent to the wall 20 and the user positions the printing apparatus 5 on the x-axis horizontal member 25 at Step 600. The user then records the starting location of the printing apparatus 5 on the selected surface 20 by inputting, via the input panel 37 the location of the starting position 520 of the printing apparatus. For example, as shown in FIG. 8, the starting position 520 can be located in a center 525, a top right 530, a top left 535, a lower right 540, or a lower left 545 position at Step 610. The user selects the image to be printed; the size the image is to be printed, and activates the mapping sequence Step 620. Next, the logic and control unit 75 activates the sensor 85. That is, the logic and control unit 75 effectively determines distance or proximity of the selected surface 20 from the sensor 85. Distance of this initial point is determined either by use of light beams 205/210 or by guide finger 90. This initial point is designated as a datum point "0" and will have coordinates of x=0, y=0 and z=distance from the sensor 85 as at Step 630. The x, y and z coordinates for the datum point "0" are sent to the logic and control unit 75 and stored therein as at Step 640. The logic and control unit 75 then activates the propulsion assembly 30 and the track drives 476 and 477 to increment the stepper motor 30 and the track stepper motors 478 and 479 a predetermined amount in order to sense a first measurement point "1" on the selected surface 20 as at Step 650. This first measurement point "1"is located at an epsilon or very small distance "δ" on the selected surface 20 in a predetermined direction from the datum point "0" as at Step 660. Moreover, this first measurement point "1" will have coordinates of $x=x_1$, $y=y_1$, and $z=z_1$, where the values of $x_1$, $y_1$ and $z_1$ are distances defining location of measurement point "1" from the datum point "0" in the well-known three-dimensional coordinate system as illustrated by Step 670. The coordinates of measurement point "1" are sent to the logic and control unit 75 and stored therein as at Step 680. The logic and control unit 75 then activates the propulsion assembly 30 and the track drives 476 and 477 to increment the stepper motor 45 and the track stepper motors 478 and 479 epsilon distance "δ" to a second measurement point "2" on the selected surface 20 as at Step 690. That is, this second measurement point "2" is located at the epsilon distance "δ" on surface 20 in a predetermined direction from first measurement point "1" as illustrated by Step 700. Moreover, this second measurement point "2" will have coordinates of $x=x_2$, $y=y_2$ and $z=z_2$, where the values of $x_2$, $y_2$ and $z_2$ are distances defining separation of measurement point "2" from the datum point "0" in the three-dimensional coordinate system as illustrated by Step 710. These coordinates of second measurement point "2" are sent to the logic and control unit 75 and stored therein as at Step 720. In similar manner, the logic and control unit 75 activates the propulsion assembly 30 and track drives 476 and 477 to increment the stepper motor 45 and the track stepper motors 478 and 479 by increments equal to epsilon distance "δ" about the entire surface 20 to establish values of x=0, 1, . . . $n_x$; y=0, 1, . . . $n_y$; and z=0, 1, 2, . . . $n_z$, where $n_x$, $n_y$ and $n_z$ equal the total number of measurement points to be taken on surface 20 in the x, y and z directions, respectively as at Step 730. Each measurement point is spaced-apart from its neighbor by epsilon distance "δ" as illustrated by Step 740. In this manner, all measurement points describing surface 20 are defined relative to initial datum point "0", which is defined by x=0, y=0 and z=distance from the sensor 85 as illustrated by Step 750. The process disclosed hereinabove results in the three-dimensional grid map 340 shown in FIG. 10*a* of the selected surface 20 being stored in the logic and control unit 75 as x, y and z coordinates as at Steps 760, 770 and 780. Alternately the entire surface need not be mapped if the dimensions of the area where the image is to be printed are known.

Figure 11C:
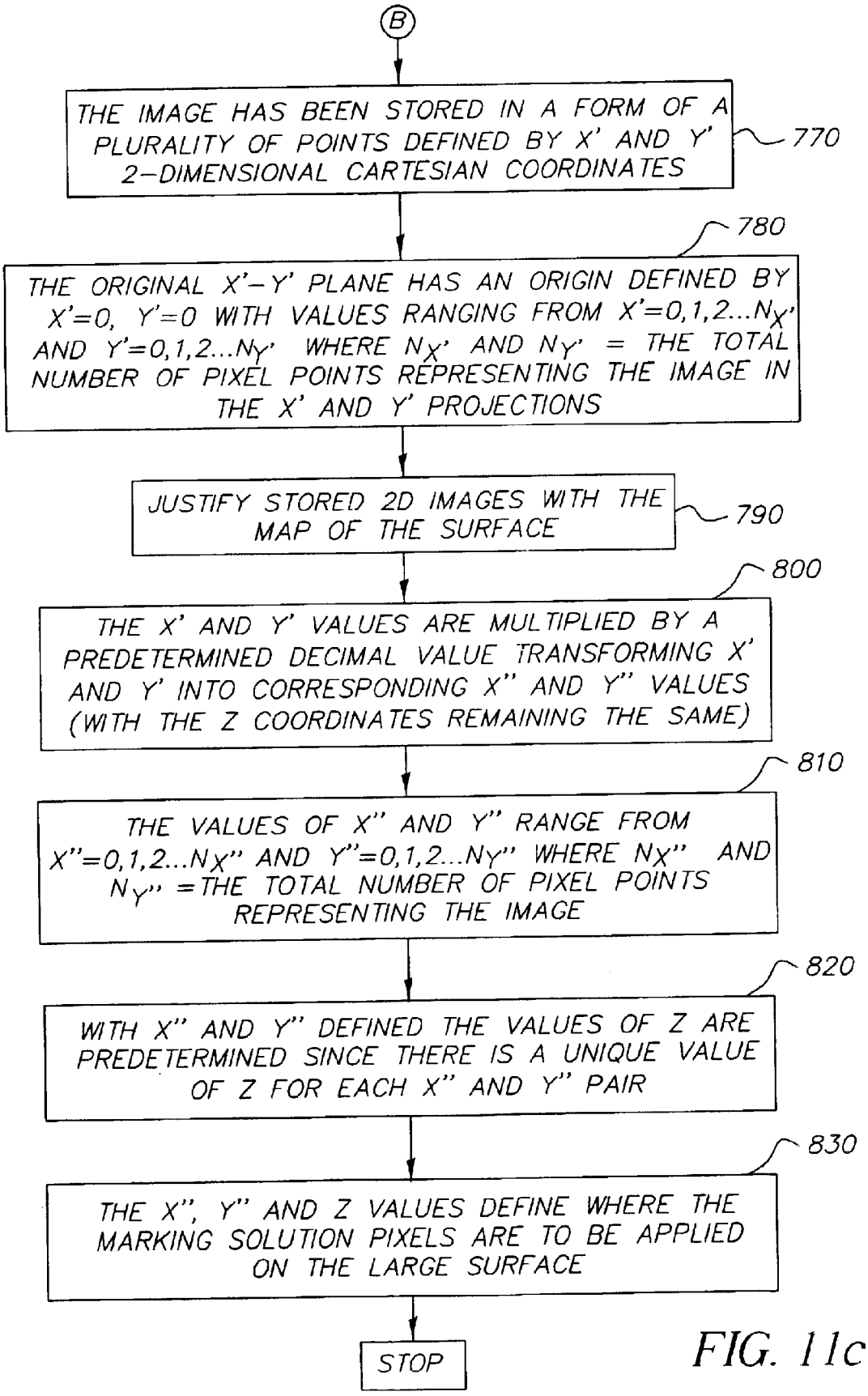

Referring to FIG. 11*c*, logic and control unit 75 performs a calculation which justifies the color image 410 stored therein with the x, y and z map 340 of the selected surface 20 as at Step 790. Preferably the color image 410 has been previously stored in the logic and control unit 75 and represented therein in the form of a plurality of color points defined by x' and y' two-dimensional coordinates. That is, each point in the color image 410 stored in the logic and control unit 75 has been previously assigned x', y' and a color value for each x' and y' value representing the color image in the x'-y' two-dimensional plane. This x'-y' plane has an origin defined by values of x'=0 and y'=0. The values in the x'-y' plane range from x'=0, 1, 2, . . . $n_{x'}$ and from y'=0, 1, 2, . . . $n_{y'}$, where $n_{x'}$ and $n_y$ equal the total number of color pixel points representing color image 410 in the x' and y' directions, respectively. The logic and control unit 75 then mathematically operates on the values defining the x'-y' plane of the color image 410 in order to justify the x', y' and color values forming color image 410 to the x and y measurement values forming the color map 340 of the selected surface 20. That is, the logic and control unit 75 multiplies each x' and y' value by a predetermined scaling factor, so that each x' and y' value is respectively transformed into corresponding x" and y" values as at Step 800. The transformation can be preformed via texture mapping techniques such as those described in *Advanced Animation and Rendering Techniques Theory and Practice* by Watt and Watt. These techniques are well known in the art. The z coordinates of the measurement values obtained by the sensor 85 remain undisturbed by this justification. That is, after logic and control unit 75 scales the x' and y' values, the logic and control unit 75 generates corresponding x" and y" values (with the z coordinate values remaining undisturbed). The x" values range from x"=0, 1, 2, . . . $n_{x''}$, and the y" values range from y"=0, 1, 2, . . . $n_{y''}$, where $n_{x'}$ and $n_{y'}$, equal the total of pixel points representing image 410 in the x" and y" directions, respectively as illustrated by Step 810. It should be understood from the description hereinabove, that once the values of x" and y" are defined, the values of z are predetermined because there is a unique value of z corresponding to each x" and y" pair as illustrated by Step 820. These values of x", y" and z define where color ink pixels are to be applied on the selected surface 20 as illustrated by Step 830. As described herein below, after the map and color image 410 stored in the logic and control unit 75 is justified, the logic and control unit 75 controls the print head 55 and the positioning mechanism 58 to print the now justified color image 410 on the selected surface. If desired, the position of a significant portion of the color image 410 in the x-y plane stored in the logic and control unit 75 may be matched to the corresponding significant portion of the selected surface 20 stored in the x'-y' plane in order to obtain the necessary justification.

The invention has been described in detail with particular reference to certain preferred embodiments thereof, but it will be understood that variations and modifications can be effected within the spirit and scope of the invention.

PARTS LIST

5 printing apparatus
10 marking engine
15 indicia
20 large surface
25 horizontal member
30 propulsion assembly
35 drive wheel
37 input panel
40*a*, 40*b* guide wheels
45 stepper motor
50 frame
55 print head
58 positioning mechanism
60 telescoping mechanism
62 the rotating mechanism
63 joint
65*a*, 65*b* arrows
70 power supply
75 logic, control and memory unit
80 communications device
85 sensor
90 guide finger
95 reservoir
100 marking solution
102 pickup pump
104 outside inlet port
105 Erasable Programmable Read Only Memory (EPROM)
108 tube
110 EPROM slot
115 arrow
150 telescoping spring-loaded follower
155 end portion
200 light source
205 light beam
215 light detector
230 locking set screw
240 cylindrical rod
245*a*, 245*b*, 245*c* channels
250*a, b, c, d* marking solutions
270 plate
271*a, b, c, d* nozzles
272 common point
273*a, b, c, d* tubing lines
274 arrow
275*a, b, c, d* channel-shaped chambers
281*a, b, c, d* nozzle orifices
282 marking solution meniscus
285 marking solution body
286 surface area
287*a, b, c, d* piezo-electric transducers
288 drop
289 arrow
290*a, b, c, d* lines
315 trapezoid shaped horizontal member
320 rack and pinion gear mechanism
325 knurled knob 325
330 rubber foot 330
335 locking screw
340 grid map
346 border
348 edge areas
350 edge areas
352 central pattern area
400*a*, 400*b* walls
410 image
450 display
455 fiducial
460 keyboard
465 arrow
468 corner
470*a*, 400*b* tracks
475 ceiling
476 track drive
477 track drive
478 track stepper motor
479 track stepper motor
480 floor
490 image
490 rubber foot
495 glass surface
497*a, b, c, d* suction devices
498 image
500 spring loaded shaft
502 curved wall
503 flat area
504 flat area
505 arrow
506 contoured area
510 threaded foot
515 knurled knob
520 starting position
525 center
530 top right
535 top left
540 lower right
545 lower left
600–830 steps

What is claimed is:

1. A printing apparatus for printing an image on a selected vertical surface of a fixed, permanent structure comprising:

a support structure adapted to be attached to the fixed, permanent structure, the support structure including at least one horizontal member adapted to be supported generally parallel to the selected vertical surface;

a marking engine including a print head for printing the image, the marking engine supported on the at least one horizontal member;

a sensor mounted on the marking engine, movement of the marking engine allowing the sensor to collect mapping data of the selected vertical surface;

a logic and control unit that stores coordinates representing the image and representing a map of the selected vertical surface and also instructs the motor to drive movement of the marking engine along the at least one horizontal member as well as telescoping and partial rotational movement of the printhead in accordance with the stored coordinates; and a motor for translating the marking engine along the at least one horizontal member.

2. A printing apparatus as recited in claim 1 wherein:

the support structure includes at least two mounting portions anchoring the support structure to at least two respective surfaces of the fixed permanent structure adjacent to the selected vertical surface.

3. A printing apparatus as recited in claim 1 wherein:

the support structure includes at least two mounting portions anchoring the support structure to the selected vertical surface.

4. A printing apparatus as recited in claim 3 wherein:

the at least two mounting portions anchoring the support structure to the selected vertical surface are suction cups.

5. A printing apparatus as recited in claim 1 wherein:

the printhead is rotatably mounted for partial rotational movement about a horizontal axis.

6. A printing apparatus as recited in claim 5 wherein:

the printhead includes a telescoping mechanism to allow for telescoping movement of the printhead along a z-axis perpendicular to the selected vertical surface.

7. A printing apparatus as recited in claim 5 wherein:

the printhead is rotatably mounted for partial rotational movement about a vertical axis.

8. A printing apparatus as recited in claim 1 wherein:

the support structure includes two vertical support tracks, the horizontal member being supported between the two vertical tracks, the horizontal member with the marking engine supported thereon being translatable in a vertical plane generally parallel to the selected vertical surface.

9. A printing apparatus as recited in claim 1 wherein:

the logic and control unit includes software that compensates for misalignment of the selected vertical surface with an adjacent surface of the fixed permanent structure generally perpendicular to the selected vertical surface.

10. A printing method for printing an image on a selected vertical surface of a fixed, permanent structure comprising the steps of:

mounting a marking engine including a sensor and a print head on a support structure including at least one horizontal member;

attaching the support structure to the fixed permanent structure such that the at least one horizontal member resides generally parallel to the selected vertical surface;

translating the marking engine along the horizontal member and mapping the selected vertical surface with the sensor mounted on the marking engine;

storing in a logic and control unit coordinates representing the image and representing a map of the selected vertical surface;

compensating for misalignment of the selected vertical surface with an adjacent surface of the fixed permanent structure that is generally perpendicular to the selected vertical surface; and controlling with the logic and control unit a motor to drive movement of the marking engine along the at least one horizontal member as well as telescoping and partial rotational movement of the printhead in accordance with the stored coordinates.

11. A printing method for printing an image on a selected vertical surface of a fixed, permanent structure comprising the steps of:

mounting a marking engine including a sensor and a print head on a support structure including at least one horizontal member;

attaching the support structure to the fixed permanent structure such that the at least one horizontal member resides generally parallel to the selected vertical surface;

translating the marking engine along the horizontal member and mapping the selected vertical surface with the sensor mounted on the marking eneine;

storing in a logic and control unit coordinates representing the image and renresenting a map of the selected vertical surface;

compensating for irregularities in the selected vertical surface; and controlling with the logic and control unit a motor to drive movement of the marking engine along the at least one horizontal member as well as telescoping and partial rotational movement of the printhead in accordance with the stored coordinates.

12. A printing method as recited in claim 11 further comprising the step of:

moving the horizontal support member vertically during both the mapping and printing steps.

* * * * *